US007236906B2

(12) United States Patent
Tokuyama

(10) Patent No.: US 7,236,906 B2
(45) Date of Patent: Jun. 26, 2007

(54) INFORMATION PROCESSING APPARATUS AND PROGRAM

(76) Inventor: Mitsuru Tokuyama, 7-2-5, Kitamikunigaoka-cho, Sakai-shi, Osaka (JP) 590-0021

( * ) Notice: Subject to any disclaimer, the term of this patent is extended or adjusted under 35 U.S.C. 154(b) by 0 days.

(21) Appl. No.: 11/284,168

(22) Filed: Nov. 22, 2005

(65) Prior Publication Data

US 2006/0235643 A1 Oct. 19, 2006

(30) Foreign Application Priority Data

Apr. 15, 2005 (JP) ..... 2005-117694

(51) Int. Cl.
*G06F 15/00* (2006.01)

(52) U.S. Cl. ..... 702/150; 342/450

(58) Field of Classification Search ..... 702/150, 702/142, 149, 153; 342/104–107, 109, 450, 342/357.06

See application file for complete search history.

(56) References Cited

U.S. PATENT DOCUMENTS 6,959,259 B2 * 10/2005 Vock et al. ..... 702/142

FOREIGN PATENT DOCUMENTS

JP 2001-518185 A 10/2001

WO WO-98/41815 A1 9/1998

OTHER PUBLICATIONS

Mitsuru Tokuyama, et al., "Individuality and reproducibility in high-speed motion of volleyball spike jumps by phase-matching and averaging", Journal of Biomechanics, Sep. 17, 2004, pp. 1-8.

* cited by examiner

*Primary Examiner*—Edward Raymond
(74) *Attorney, Agent, or Firm*—Rader, Fishman & Grauer PLLC

(57) ABSTRACT

An information processing apparatus includes a motion information receiving portion that receives multiple pieces of motion information, which is time-series information, a motion information alteration portion that alters a positional relationship in a time axis direction between the multiple pieces of the motion information, a correlation information acquisition portion that acquires, for multiple pieces of the motion information, correlation information, which is information relating to a correlation between pieces of the motion information, and a motion information acquisition portion that acquires, based on the correlation information acquired by the correlation information acquisition portion, multiple pieces of the motion information having a positional relationship in the time axis direction at which the correlation between the pieces of the motion information is optimal. This configuration makes it possible to align multiple pieces of information relating to motion in a good balance as a whole, without disturbing their original waveforms.

23 Claims, 14 Drawing Sheets

INFORMATION PROCESSING APPARATUS AND PROGRAM

BACKGROUND OF THE INVENTION

1. Field of the Invention

The present invention relates to an information processing apparatus and the like that process, for example, information relating to motion of objects, in particular, motion of humans while playing sports and the like.

2. Description of Related Art

As an example of a tool for acquiring motion of objects as digitized data, a tool that measures the position and motion of objects is known (e.g., see JP2001-518185A (e.g., page 1 and FIG. 1)).

Using such a tool allows time-series motion of objects, such as that of humans and animals, to be displayed in waveform graphs and the like. This makes it possible to analyze the motion of a human body, and it seems that from the results of that analysis, it is possible to predict, for example, the parts of the human body that are susceptible to problems.

In the case of analyzing such motion information of humans or animals, it is essential to make comparisons between data sets, or to determine the average of multiple pieces of information. In this case, it is necessary that the multiple pieces of the information can be arranged in alignment in a time axis direction, without disturbing their original waveforms.

However, there has not been established any apparatus or method for arranging multiple pieces of such information in alignment. Therefore, in the case of analyzing motion information of humans or animals, multiple pieces of the information are aligned, for example, by analysts based on their experiences or intuitions. Consequently, the resulting information lacks objectivity, leading to the problem that the reliability of the information is reduced and the information has poor reproducibility. Particularly, in the case of analyzing information of complex motions, the positional relationship between pieces of information will vary depending on, for example, what particular movement included in the complex motion is given attention in order to align pieces of the information, so that many factors need to be considered in performing the alignment, making it difficult to align the information objectively.

For example, let us consider a case where the same motion is performed twice, then a waveform representing motion is acquired from each of the motions, and the waveforms are aligned with each other. At this time, if the time between the start and the end greatly differs between the two motions, then it is conceivable, for example, that when the start time of the motions are aligned, the positional shift between the waveforms increases as the end of the motions approaches. Furthermore, even if particular peaks of the waveforms are aligned with each other, it is conceivable, for example, that the positional shift between the waveforms increases at other parts. As such, it has been difficult to objectively align waveforms, while giving consideration to the balance between the waveforms as a whole.

It is also conceivable to match the start time and the end time between two motion waveforms by changing one of the motion waveforms, thereby aligning the waveforms. However, the details of, for example, the timing or form of motion and the like of humans vary depending on, for example, the duration of the entire motion. For example, the form of a human while running slowly and the form of a human while running fast are completely different. Therefore, even if the duration of a waveform representing motion obtained from the form when running slowly is changed in accordance with the duration of a waveform representing motion in running fast, the resulting waveform will be completely different from the waveform representing motion when running fast. For this reason, performing alignment by changing the waveform in this manner is not appropriate for alignment of waveforms representing motion, especially in the case of analyzing motion, for example.

SUMMARY OF THE INVENTION

An information processing apparatus according to the present invention includes: a motion information receiving portion that receives multiple pieces of motion information, which is time-series information relating to motion of an object; a motion information alteration portion that alters a positional relationship in a time axis direction between the multiple pieces of the motion information; a correlation information acquisition portion that acquires, for multiple pieces of the motion information, correlation information, which is information relating to a correlation between pieces of the motion information; and a motion information acquisition portion that acquires, based on the correlation information, multiple pieces of the motion information having a positional relationship in the time axis direction at which the correlation between those pieces of the motion information is optimal.

With this configuration, it is possible to objectively align multiple pieces of motion information in a time axis direction, while giving consideration to the balance between the pieces of motion information as a whole, so that it is possible to obtain information with high reliability and good reproducibility from multiple pieces of motion information.

Furthermore, in the above-described information processing apparatus, the motion information alteration portion shifts at least one piece of the motion information in the time axis direction, thereby altering the positional relationship in the time axis direction between the multiple pieces of the motion information.

With this configuration, it is possible to objectively align multiple pieces of motion information in a time axis direction, while giving consideration to the balance between the pieces of motion information as a whole, so that it is possible to obtain information with high reliability and good reproducibility from multiple pieces of motion information.

Furthermore, in the above-described information processing apparatus, the correlation information acquisition portion acquires the correlation information based on values of the multiple pieces of the motion information at two or more predetermined times.

With this configuration, it is possible to objectively align multiple pieces of motion information in a time axis direction, while giving consideration to the balance between the pieces of motion information as a whole, so that it is possible to obtain information with high reliability and good reproducibility from multiple pieces of motion information.

Furthermore, in the above-described information processing apparatus, the correlation information is an average value of an absolute value of a difference between values of the multiple pieces of the motion information at two or more predetermined times.

With this configuration, it is possible to objectively align multiple pieces of motion information in a time axis direction, while giving consideration to the balance between the pieces of motion information as a whole, so that it is possible to obtain information with high reliability and good reproducibility from multiple pieces of motion information.

Furthermore, in the above-described information processing apparatus, the motion information acquisition portion acquires multiple pieces of the motion information having a positional relationship in the time axis direction that renders the average value small.

With this configuration, it is possible to objectively align multiple pieces of motion information in a time axis direction, while giving consideration to the balance between the pieces of motion information as a whole, so that it is possible to obtain information with high reliability and good reproducibility from multiple pieces of motion information.

Furthermore, the above-described information processing apparatus further include: a motion information synthesizing portion that synthesizes the multiple pieces of the motion information acquired by the motion information acquisition portion; and an output portion that outputs the motion information synthesized by the motion information synthesizing portion.

With this configuration, it is possible to synthesize motion information with high reliability and good reproducibility from multiple pieces of motion information.

Furthermore, in the above-described information processing apparatus, the motion information synthesizing portion forms motion information having as its values at multiple times an average of values of the multiple pieces of the motion information at the corresponding multiple times that are acquired by the motion information acquisition portion.

With this configuration, it is possible to synthesize motion information with high reliability and good reproducibility from multiple pieces of motion information.

Furthermore, in the above-described information processing apparatus, the motion information receiving portion receives two pieces of the motion information, and one of the pieces of the motion information is the motion information that is output by the output portion.

With this configuration, it is possible to synthesize motion information with high reliability and good reproducibility from three or more pieces of motion information. Moreover, since two pieces of motion information are processed at a time, it is possible to decrease the amount of information to be processed, thus reducing the processing time even for an information processing apparatus with a low processing speed.

Furthermore, the above-described information processing apparatus further includes a motion information analyzing portion that analyzes the motion information synthesized by the motion information synthesizing portion, wherein the output portion outputs an analysis result of the motion information analyzing portion.

With this configuration, analysis of motion information is performed using, as a typical value, motion information with high reliability and good reproducibility that has been synthesized based on multiple pieces of motion information, so that it is possible to attain a high quality analysis result with high reliability and good reproducibility.

Furthermore, in the above-described information processing apparatus, the motion information is information relating to a motion while playing volleyball.

With this configuration, it is possible to provide information for objectively determining, for example, the body condition of individual volleyball players and what problems each player is susceptible to. Moreover, by outputting an analysis result on this information, it is possible for even a person who lacks specialized knowledge to give advice or the like for improvement.

Furthermore, in the above-described information processing apparatus, the motion information is information relating to a motion while playing baseball.

With this configuration, it is possible to provide information for objectively determining, for example, the body condition of individual baseball player and what problems each player is susceptible to. Moreover, by outputting an analysis result on this information, it is possible for even a person who lacks specialized knowledge to give advice or the like for improvement.

With an information processing apparatus and the like according to the present invention, it is possible to obtain information with high reliability and good reproducibility from multiple pieces of motion information.

DETAILED DESCRIPTION OF THE INVENTION

Figure 1:
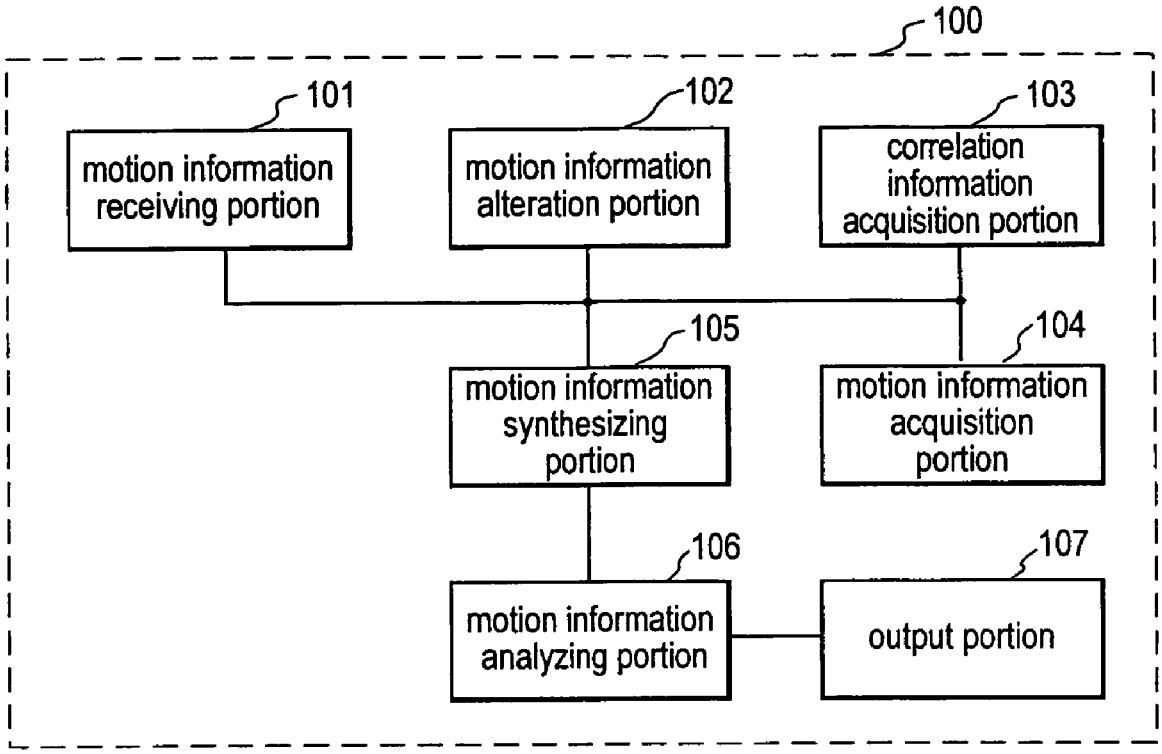
FIG. 1 is a block diagram showing the configuration of an information processing apparatus according to an embodiment of the present invention.

Hereinafter, embodiments of the information processing apparatus and the like according to the present invention will be described with reference to the accompanying drawings. It should be noted that components and steps that are denoted by the same reference numerals in the embodiments perform the same operation, and therefore may not be described in duplicate.

FIG. 1 is a block diagram showing the configuration of an information processing apparatus according to this embodiment. The information processing apparatus 100 according to this embodiment is provided with a motion information receiving portion 101, a motion information alteration portion 102, a correlation information acquisition portion 103, a motion information acquisition portion 104, a motion information synthesizing portion 105, a motion information analyzing portion 106 and an output portion 107.

The motion information receiving portion 101 receives multiple pieces of motion information that is time-series information relating to motion of an object. "Object" may be any object. For example, it may be a part or the whole of a human or an animal, or may be an instrument that produces motion when handled by a human, such as a bat, a tennis racket or a golf club. "Motion of an object" refers to, for example, the movement, rotation and deformation of an object. In this embodiment, motion of objects refers particularly to motion of humans or instruments or the like used by humans, when humans play sports. Examples include motion of the foot of a player when the player kicks the ball while playing soccer, motion of the body of a player when the player spikes the ball while playing volleyball, motion of the arm of a pitcher when the pitcher throws the ball while playing baseball, motion of a bat when a batter hits the ball with the bat while playing baseball, and motion of a racket when a player serves the ball with the racket while playing tennis. Specifically, information "relating to motion of an object" refers to, for example, information obtained by digitizing information representing the motion of an object, or information calculated based on this digitized information. "Time-series information" means information given for different points in time. "Motion information" may be, for example, information of spatial coordinates of an object that were sampled with a predetermined time interval. It may also be vector information that was sampled with a predetermined sampling time interval or calculated based on information of two or more coordinates on multiple objects, or information indicating the angle of an object. Furthermore, motion information may also be kinetic information, such as joint moment or floor reaction force. There is no particular limitation with respect to the data structure of the motion information. As the apparatuses or techniques for acquiring such motion information from an object, a motion capture apparatus for capturing motion of humans and the related techniques are widely known, for example. Since the techniques for acquiring such motion information are publicly known, their detailed description has been omitted here. The motion information receiving portion 101 may receive the motion information from another apparatus such as the above-mentioned motion capture apparatus via a network, a bus or the like. Input received by the motion information receiving portion 101 may be any input, including, for example, input from a keyboard or a mouse, and information that is read in from a magnetic disk or an optical disk. The motion information receiving portion 101 may or may not include input means such as a keyboard or an optical disk drive. It may include a receiving device, such as a modem or a network, for receiving the motion information from another device. The motion information receiving portion 101 may be implemented, for example, with a device driver for input means such as a keyboard or an optical disk drive, or a driver for driving a receiving device.

The motion information alteration portion 102 alters the positional relationship in a time axis direction between multiple pieces of the motion information received by the motion information receiving portion 101. Specifically, the motion information alteration portion 102 shifts in the time axis direction, that is, moves in a parallel direction, the whole of at least one of the multiple pieces of the motion information received by the motion information receiving portion 101, thereby altering the positional relationship in the time axis direction between the pieces of the motion information. Specifically, the positional relationship as mentioned herein refers to the relative positional relationship between multiple pieces of the motion information. For example, the relative positional relationship does not change if all the pieces of the motion information are shifted by the same value in the same direction, whereas the relative positional relationship changes if only one of the pieces of the motion information is shifted. The width, i.e. the value by which each piece of the motion information is shifted in the time axis direction by the motion information alteration portion 102 may be a fixed value or any given value. Further, this value may or may not be constant. It may be also an integral multiple of a predetermined value. There is no particular limitation with respect to this value by which the motion information is shifted in the time axis direction. When each piece of the motion information is information given for predetermined sampling time intervals, such as information obtained by sampling the position or the like of an object with a predetermined sampling time interval, or information or the like calculated based on such information, it is preferable that the value by which each piece of the motion information is shifted by the motion information alteration portion 102 is set taking this predetermined sampling time interval as a time unit. The reason is that measured values obtained by the sampling can be aligned between multiple pieces of the motion information, even after altering their positional relationship. Here, a case is described where the motion information alteration portion 102 uses, as the input, all the pieces of the motion information received by the motion information receiving portion 101 to alter the positional relationship between these pieces of the motion information, and then all the pieces of the motion information whose positional relationship has been altered are output. However, it is also possible to output only the piece of the motion information that needs to be shifted in the time axis direction in order to alter the positional relationship, and then to output only the shifted piece of the motion information. In this case, the later-described motion information acquisition portion 104 needs to acquire the motion information that has not been shifted, directly from the motion information receiving portion 101. The motion information alteration portion 102 may be implemented, for example, with an MPU or a memory. The operation of the motion information alteration portion 102 may be implemented, for example, with software, which may be recorded in a recording medium such as a ROM. However, it may also be implemented with hardware such as a dedicated circuit. In addition, the motion information alteration portion 102 may temporarily store the pieces of the motion information whose positional relationship in the time axis direction has been altered in a storage medium such as a memory.

The correlation information acquisition portion 103 acquires, for multiple pieces of the motion information, correlation information, which is information relating to a correlation between pieces of the motion information. Specifically, the correlation information acquisition portion 103 acquires the correlation information based on the values of the multiple pieces of the motion information at two or more predetermined times. Usually, the correlation information acquisition portion 103 acquires by calculation the correlation information based on the values of the multiple pieces of the motion information at two or more predetermined times. When the correlation information acquisition portion 103 acquires the correlation information, the multiple pieces of the motion information from which the correlation information is acquired may or may not include the multiple pieces of motion information as were received by the motion information receiving portion 101. Here, a case is described where the correlation information acquisition portion 103 acquires the correlation information for multiple pieces of the motion information whose positional relationship in the time axis direction has been altered by the motion information alteration portion 102, for every different positional relationship, in addition to acquiring the correlation information for multiple pieces of the motion information received by the motion information receiving portion 101. This correlation information may be any information that indicates a correlation, i.e., a degree of association between multiple pieces of the motion information. Specifically, the correlation information may be, for example, the average value or sum of the absolute value of a difference between the values of multiple pieces of the motion information at two or more predetermined times. Alternatively, it may be, for example, the average or sum of a power, such as the square or the cube, of a difference between the values of multiple pieces of the motion information. The correlation information may also be the average or the sum of values obtained from multiple values of each piece of the motion information at predetermined times by the least squares method. The correlation information may or may not be information expressed with numerical values. For example, correlation information not expressed with numerical values, such as "high" or "low", in accordance with, for example, the average value of the absolute value of a difference between the values of multiple pieces of the motion information at two or more predetermined times may be acquired from, for example, a table defining the relationship between the average value and the correlation information. As the two or more predetermined times, it is preferable to set two or more times that are separated from each other at a time interval that is a multiple of the sampling time period as described above. The reason is that this makes it possible to determine the correlation information using pieces of information that have been actually collected by sampling or the like, rather than using information that has undergone interpolation or the like. There is no particular limitation with respect to the data structure of the correlation information. The correlation information acquisition portion 103 may be implemented, for example, with an MPU or a memory. The operation of the correlation information acquisition portion 103 may be implemented, for example, with software, which may be recorded in a recording medium such as a ROM. However, it may be also implemented with hardware such as a dedicated circuit. In addition, the correlation information acquisition portion 103 may temporarily store the acquired correlation information in a storage medium such as a memory.

The motion information acquisition portion 104 acquires, based on the correlation information acquired by the correlation information acquisition portion 103, multiple pieces of the motion information having a positional relationship in the time axis direction at which the correlation between the pieces of the motion information is optimal. Specifically, the motion information acquisition portion 104 acquires multiple pieces of the motion information in a positional relationship that provides correlation information indicating that the correlation between the multiple pieces of the motion information is optimal by comparing the correlation information received by the correlation information acquisition portion 103 for the multiple pieces of the motion information received by the motion information receiving portion 101 and the correlation information acquired by the correlation information acquisition portion 103 for the multiple pieces of the motion information whose positional relationship has been altered by the motion information alteration portion 102. "Optimal correlation" usually refers to a high degree of association. Specifically, if the correlation information is the average value of the absolute value of a difference between the values of multiple pieces of the motion information at multiple times as described above, then the smallest average value indicates an optimal correlation. However, it is possible to set, as necessary, such that multiple pieces of the motion information that provide an average value slightly greater than the smallest average value indicates an optimal correlation. The motion information acquisition portion 104 may acquire multiple pieces of the motion information having a positional relationship in the time axis direction at which the correlation between the pieces of the motion information is optimal in any manner. For example, if multiple pieces of the motion information having a positional relationship in the time axis direction at which the correlation is optimal and that have been formed by the motion information alteration portion 102 are stored in a memory or the like, then those the multiple pieces of the motion information may be obtained from the memory or the like. On the other hand, if the motion information alteration portion 102 includes information indicating a positional relationship in the time axis direction at which the correlation between the pieces of the motion information is optimal, then it is possible to appropriately shift multiple pieces of the motion information received by the motion information receiving portion 101, based on the information indicating this positional relationship, thereby forming and acquiring pieces of the motion information having a positional relationship in the time axis direction at which the correlation between the pieces of motion information is optimal. The motion information acquisition portion 104 may be implemented, for example, with an MPU or a memory. The operation of the motion information acquisition portion 104 may be implemented, for example, with software, which may be recorded in a recording medium such as a ROM. However, it may also be implemented with hardware such as a dedicated circuit. In addition, the motion information acquisition portion 104 may temporarily store the acquired motion information in a storage medium such as a memory.

The motion information synthesizing portion 105 synthesizes multiple pieces of the motion information acquired by the motion information acquisition portion 104. Specifically, "to synthesize" means to form at least one piece of the motion information based on multiple pieces of the motion information. The motion information synthesizing portion 105 may synthesize multiple pieces of the motion information in any manner. For example, the motion information synthesizing portion 105 may form one piece of the motion information having as its values at multiple times an average of values of the multiple pieces of the motion information at the corresponding multiple times that are acquired by the motion information acquisition portion 104. This average value may be an average value obtained by a weighted average method. Alternatively, the motion information synthesizing portion 105 may form one piece of the motion information having as its values at multiple times a value calculated, based on the least squares method, from values of the multiple pieces of the motion information at the corresponding multiple times that are acquired by the motion information acquisition portion 104. Preferably, the multiple times may be set to all the times at which the multiple pieces of the motion information have a value, in order to obtain data with high accuracy. The motion information synthesizing portion 105 may be implemented, for example, with an MPU or a memory. The operation of the motion information synthesizing portion 105 may be implemented, for example, with software, which may be recorded in a recording medium such as a ROM. However, it may also be implemented with hardware such as a dedicated circuit.

The motion information analyzing portion 106 analyzes the motion information synthesized by the motion information synthesizing portion 105. The motion information analyzing portion 106 may analyze the motion information in any manner. For example, the motion information analyzing portion 106 may be provided with motion information for comparison in advance, then compare this motion information for comparison with the motion information synthesized by the motion information synthesizing portion 105 to acquire information indicating a correlation therebetween, and then obtain an analysis result constituted by this acquired information. Alternatively, the motion information analyzing portion 106 may associate this information indicating a correlation with an evaluation, comments or the like on the analysis result of the motion information corresponding to that correlation, and store them in a table or the like in advance, and then fetch the evaluation, comments or the like associated with acquired information indicating a correlation from this table to obtain an analysis result constituted by the evaluation, comments or the like. Here, as the information indicating the correlation, it is possible to acquire and use information similar to the correlation information acquired by the correlation information acquisition portion 103. The motion information analyzing portion 106 may be implemented, for example, with an MPU or a memory. The operation of the motion information analyzing portion 106 may be implemented, for example, with software, which may be recorded in a recording medium such as a ROM. However, it may also be implemented with hardware such as a dedicated circuit.

The output portion 107 outputs the analysis result analyzed by the motion information analyzing portion 106. Output as mentioned herein is a concept that includes, for example, display on a display, printing to a printer, sound output, and transmission to an external apparatus. The output portion 107 may or may not include an output device such as a display or a speaker. The output portion 107 may be implemented, for example, with software for performing output processing, or a combination of software for performing output processing, driver software for an output device and the driver software.

Next, the operation of the information processing apparatus 100 according to this embodiment will be described with the flowchart of FIG. 2. Here, a case will be described where two pieces of the motion information are received by the motion information receiving portion 101.

(Step S201) It is judged whether the motion information receiving portion 101 has received two pieces of the motion information. If they have been received, then the procedure advances to Step S202, and if they have not been received, then the procedure returns to Step S201. Here, it is assumed that these two pieces of the motion information are a first motion information and a second motion information.

(Step S202) The correlation information acquisition portion 103 acquires the correlation information between the first motion information and the second motion information. A specific example of this process of acquiring the correlation information will be described in detail later with reference to FIG. 3.

(Step S203) The correlation information acquisition portion 103 stores the correlation information acquired in Step S202 in a memory or the like.

(Step S204) The motion information alteration portion 102 sets the counter K to 1, which is the initial value.

(Step S205) The motion information alteration portion 102 acquires the first and the second motion information received by the motion information receiving portion 101.

(Step S206) The motion information alteration portion 102 moves the second motion information received by the motion information receiving portion 101 in the time axis direction by a value that is K times the preset value m (m is a positive value). Accordingly, the positional relationship in the time axis direction between the first motion information and the second motion information is altered as compared with the positional relationship in the time axis direction between the first motion information and the second motion at the time when they were received by the information motion information receiving portion 101. The motion information alteration portion 102 stores the first motion information and the second motion information whose positional relationship has been altered in a memory or the like.

(Step S207) The correlation information acquisition portion 103 acquires the correlation information between the first motion information and the second motion information whose positional relationship in the time axis direction has been altered in the motion information alteration portion 102 in Step S206, using a process similar to that of Step S202.

(Step S208) The correlation information acquisition portion 103 stores the acquired correlation information in a memory or the like.

(Step S209) The motion information alteration portion 102 judges whether the value of the counter K is less than the preset value j (j is an integer equal to or greater than 1). The value j is a value for setting the maximum value at the time of shifting the second motion information in the time axis direction, and the maximum value at the time of shifting the second motion information in the time axis direction is j times the above-described predetermined amount m, i.e., m×j. The value j may be set to any value. For example, it may be set such that those portions of the first and the second motion information that seem to be the major portions do not substantially overlap with each other when the second motion information is shifted by the maximum value m×(j+1). If the value of the counter K is less than j, then the procedure advances to Step S210, and if it is equal to or greater than j, then the procedure advances to Step S211.

(Step S210) The motion information alteration portion 102 increments the value of the counter K by 1. Thereafter, the procedure returns to Step S206.

(Step S211) The motion information acquisition portion 104 compares multiple pieces of the correlation information that have been acquired by the correlation information acquisition portion 103 and stored in a memory or the like to determine the correlation information indicating an optimal correlation between the multiple pieces of the motion information. For example, when information indicating that the correlation between pieces of the motion information increases with a decrease of the value of the correlation information is used as the correlation information, the motion information acquisition portion 104 determines the correlation information having the smallest value to be such correlation information.

(Step S212) The motion information acquisition portion 104 acquires the first and the second motion information that have been determined in Step S211 and that have a positional relationship in the time axis direction corresponding to the correlation information indicating an optimal correlation between the multiple pieces of the motion information, either from the motion information alteration portion 102 or from the motion information receiving portion 101.

(Step S213) The motion information synthesizing portion 105 synthesizes the first and the second motion information acquired in Step S212 to provide one piece of the motion information. A specific example of this synthesizing process will be described later.

(Step S214) The motion information analyzing portion 106 analyzes the motion information synthesized in Step S213. A specific example of this analyzing process will be described later.

(Step S215) The output portion 107 outputs the analysis result obtained in Step S214. Then, the process is terminated.

Here, the counter K was used, and the correlation information acquisition portion 103 forms the first and the second motion information whose positional relationship in the time axis direction has been shifted until the counter K has reached the value j. However, for example, the motion information alteration portion 102 may judge whether the positional relationship between the first and the second motion information is to be shifted further, based on the change in the correlation information that is output by the correlation information acquisition portion 103. For example, the alteration of the positional relationship in the time axis direction may be terminated if the correlation information that is output by the correlation information acquisition portion 103 has a value indicating a lower correlation between the first and the second motion information than the correlation information that has been output in the previous instance, for at least a predetermined number of consecutive times.

In addition, when the correlation information acquisition portion 103 does not acquire the correlation information for the first and the second motion information as were received by the motion information receiving portion 101, the processes of Step S202 and Step S203 may be omitted. In this case, it is necessary to set the above-described value j to at least 2.

Next, a specific example of the process of acquiring the correlation information in Step S202 and Step S207 in FIG. 2 will be described in detail with reference to the flowchart of FIG. 3. Here, a case will be described where the correlation information is the average value of the absolute value of a difference between the first motion information and the second motion information at multiple times. It should be noted that in this case, it is determined that when this average value is smallest, the correlation between the first motion information and the second motion information is highest, and therefore the correlation between the first motion information and the second motion information is optimal.

(Step S300) The correlation information acquisition portion 103 sets the counter n to 1.

(Step S301) The correlation information acquisition portion 103 sets the acquisition time TA, which is the time at which the value of the first motion information and that of the second motion information are acquired, to a predetermined start time. The predetermined start time may be set in any manner. For example, the predetermined start time TS may be set to a time at which sampling or the like of the first or second motion information is started, or to a time at which little time has elapsed from that time.

(Step S302) The correlation information acquisition portion 103 judges whether the value of the first motion information is present at the acquisition time TA. If it is present, then the procedure advances to Step S303, and if it is not present, then the procedure advances to Step S307.

(Step S303) The correlation information acquisition portion 103 judges whether the value of the second motion information is present at the acquisition time TA. If it is present, then the procedure advances to Step S304, and if it is not present, then the procedure advances to Step S307. The processes of Step S302 and Step S303 are processes for preventing the acquisition of values at times when there is some data omission when the first and the second motion information are measured values.

(Step S304) The correlation information acquisition portion 103 acquires the value of the first motion information and that of the second motion information at the acquisition time TA.

(Step S305) The correlation information acquisition portion 103 acquires the absolute value of a difference between the first motion information and the second motion information. The result of the acquisition is stored in a memory or the like.

(Step S306) The correlation information acquisition portion 103 increments the counter n by 1.

(Step S307) The correlation information acquisition portion 103 increments the value of the acquisition time TA by the value p. This value p is a time interval for setting the interval between multiple times at which the absolute value of a difference between the values of the first and the second motion information is acquired.

(Step S308) It is judged whether the acquisition time TA is within a predetermined end time. If it is within the predetermined end time, then the procedure returns to Step S302, and if it exceeds the end time, then the procedure advances to Step S309. The predetermined end time may be set to any time. For example, it may be a time that has been set based on the average time at which the motion that is the target of the motion information is considered to be completed, or a time that is either earlier or later than such a time. However, if the predetermined end time is set to a later time, then the absolute value of a difference between pieces of information relating to motion other than the motion that is the target of the motion information will be acquired, so that information with high accuracy may not be obtained.

(Step S309) The sum of the absolute value of a difference that has been stored in Step S305 is determined.

(Step S310) The correlation information acquisition portion 103 divides the sum of the absolute value of a difference determined in Step S309 by the value of the counter n to acquire the average value of the absolute values of a difference between the first motion information and the second motion information acquired at multiple times. It then returns the acquired average value to a higher order function. This average value is the correlation information, as described above.

Figure 4:
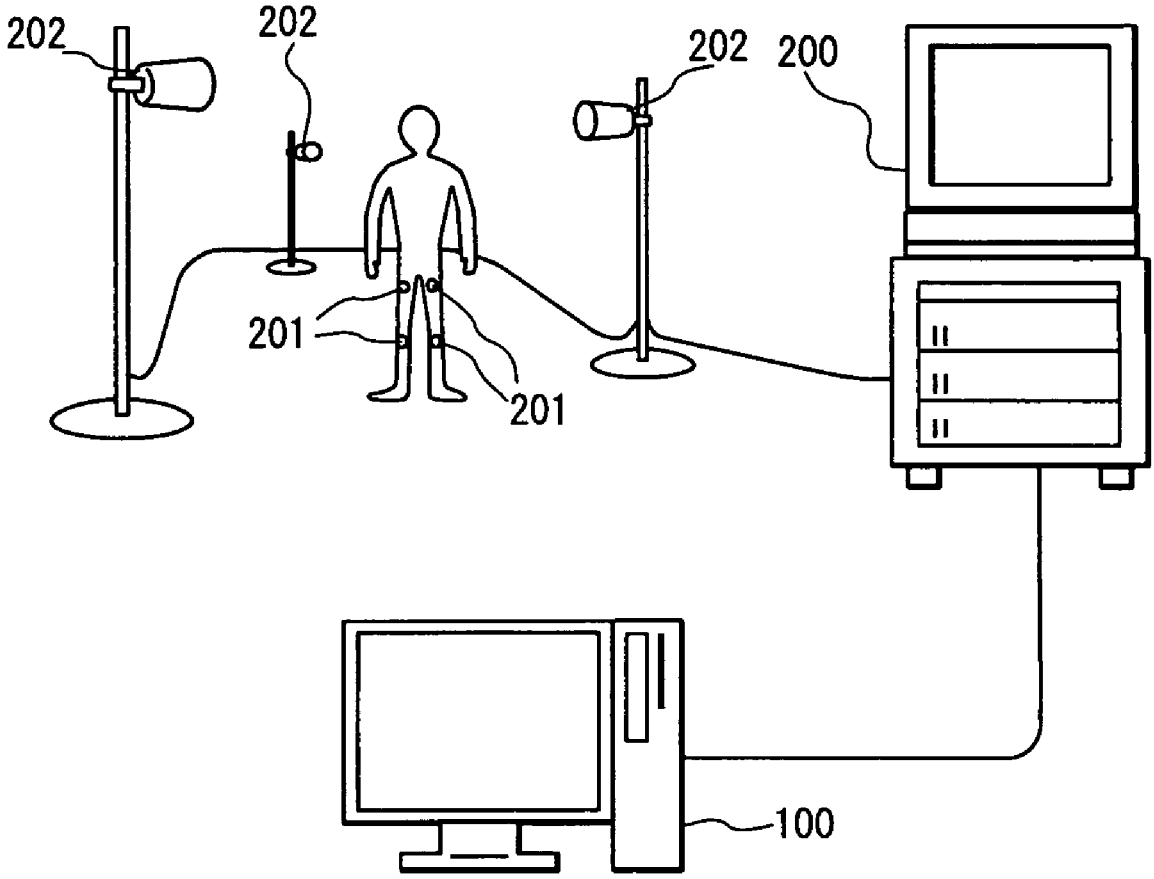
FIG. 4 is a diagram schematically showing the configuration of the information processing apparatus.

Next, a specific example will be described. FIG. 4 is a diagram schematically showing an information processing apparatus according to this embodiment. A motion acquisition apparatus 200 is an apparatus for acquiring motion information. The motion acquisition apparatus 200 as used herein receives reflected light obtained from one or more light-reflective markers 201 attached to an object that is subject of motion measurement with light-receiving sensors 202, and measures the spatial coordinates of the light-reflective markers from the reflected light over time. For example, this coordinate time-series information of the spatial coordinates of the light-reflective markers, or a value derived using this coordinate information is the motion information. One example of this motion acquisition apparatus 200 is VICON (manufactured by Vicon Peak). Here, it is assumed that multiple pieces of motion information acquired by the motion acquisition apparatus 200 are input into the information processing apparatus 100 via a network.

In this specific example, a case will be described where motion in the vicinity of legs of a volleyball player while performing a jump to spike the ball (hereinafter, referred to as "spike jump") is analyzed using the information processing apparatus 100.

One of the serious disorders for volleyball players is the so-called "jumper's knee". The possibility of developing this disorder is considered to vary depending on the form of the spike jump performed by volleyball players. Therefore, by comparing the form while performing a spike jump of a subject with the form while performing a spike jump of a player who actually had jumper's knee, and obtaining the correlation between them, it is possible to judge whether the form of the subject tend to cause jumper's knee, and to inform the subject of the result of that judgment, for example, for the purpose of improving the form, thereby preventing the occurrence of jumper's knee. For this purpose, it is necessary, first of all, to understand the average form while performing a spike jump of the subject. In order to do so, it is necessary to acquire motion information for multiple spike jumps by measurement, and to synthesize these pieces of motion information to obtain the average motion information of the subject while performing a spike jump. Therefore, here, motion of the subject is measured for two spike jumps first, then two pieces of motion information are acquired from the result of this measurement, and these pieces of motion information are synthesized.

Figure 5A:
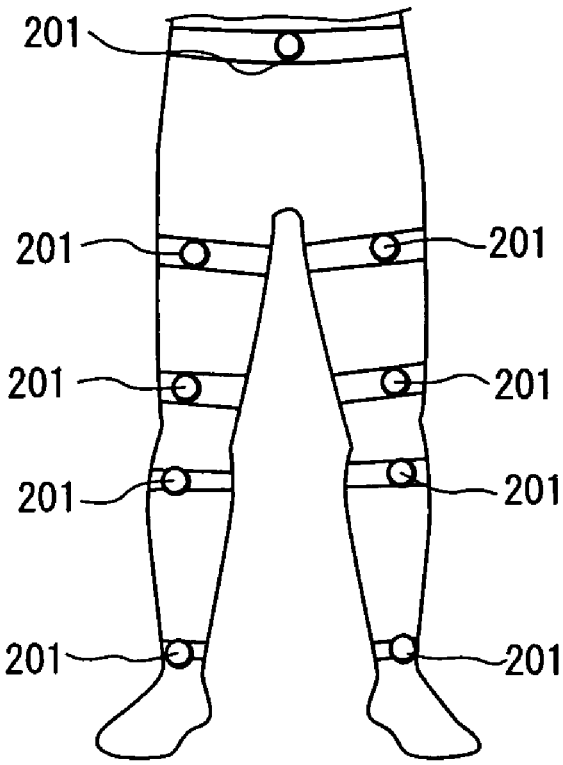
FIG. 5A and FIG. 5B are diagrams for illustrating pieces of motion information received by the information processing apparatus.
Figure 5B:
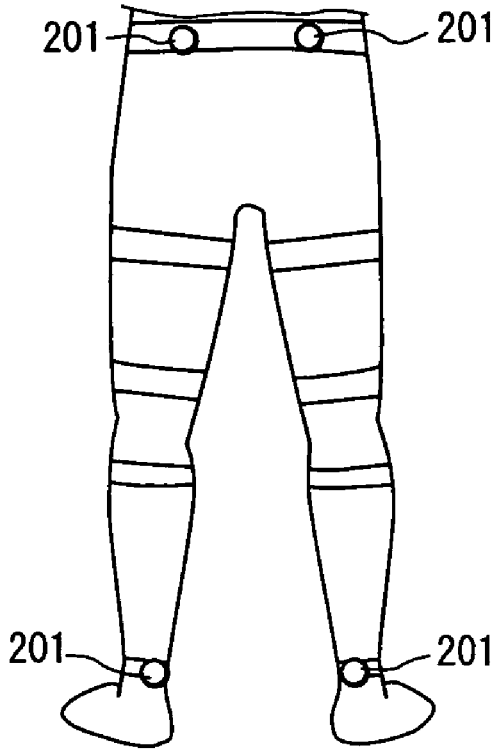
Figure 6:
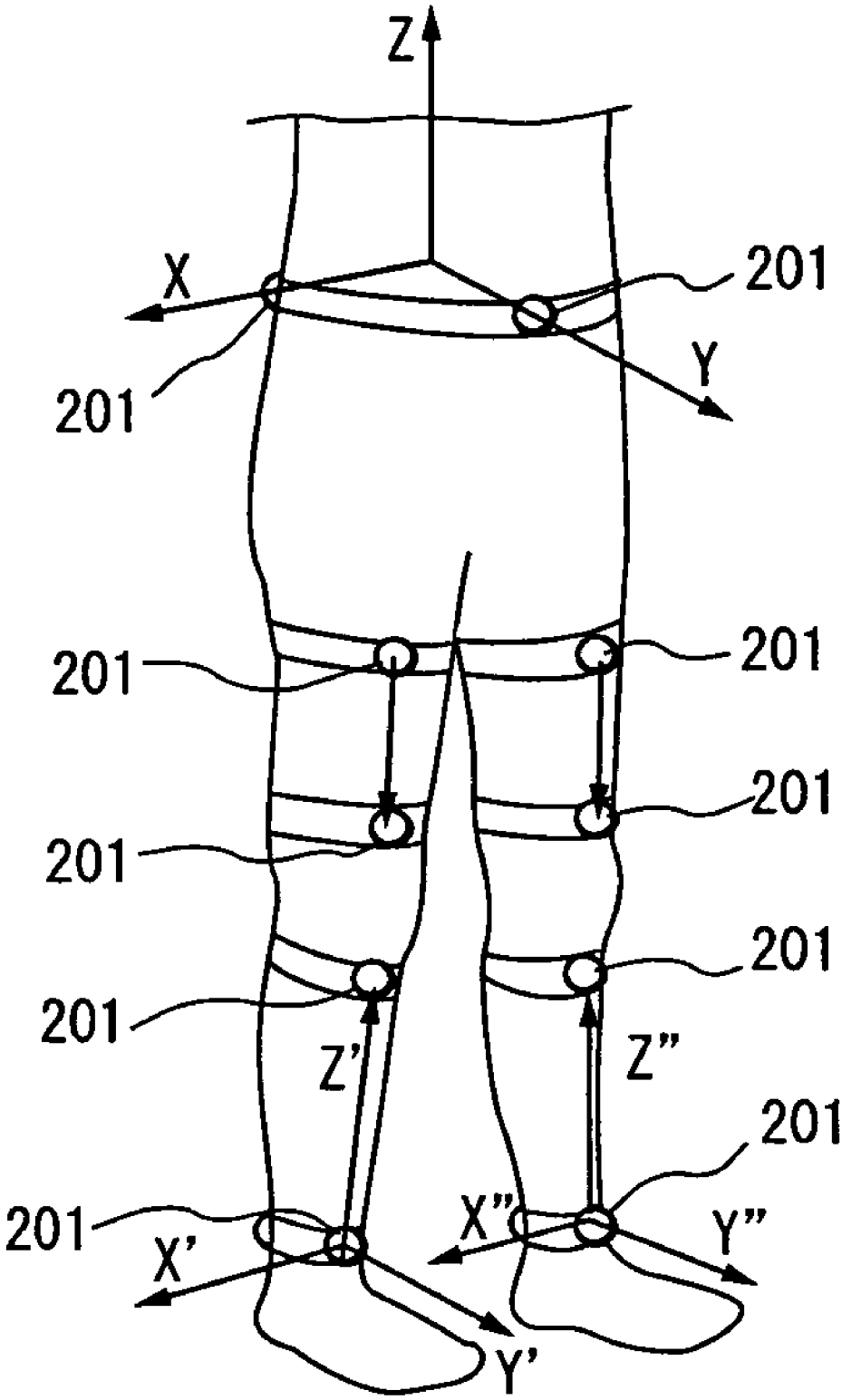
FIG. 6 is a diagram for illustrating pieces of motion information received by the information processing apparatus.

FIG. 5A and FIG. 5B are a front view and a rear view, respectively, of the lower half of the body of a volleyball player. First, as shown in FIGS. 5A and 5B, the light-reflective markers 201, three for the pelvis, two for each of the right and left thighs, and three for each of the right and left lower legs, are attached to the volleyball player, then the same player performs two spike jumps, and the spatial coordinates of these markers 201 are measured in a time-series using the motion acquisition apparatus 200. The sampling rate during this measurement is set to 240 Hz. That is, the sampling time interval is set to 1/240 second. From the result of this measurement, the flexion angles of the hip joints and the knee joints on both sides are calculated. As shown in FIG. 6, as the flexion angles of the right and left hip joints (hereinafter, referred to as "hip joint flexion angles), two-dimensional flexion angles are determined for a case where a rectangular coordinate system (x, y, z) is set with the three light-reflective markers at the pelvis, and the vectors obtained respectively from the coordinates of the two light-reflective markers at the right and left thighs are projected onto a plane corresponding to a sagittal plane at these rectangular coordinates, i.e., the plane dividing the body into symmetrical right and left halves or a plane parallel to this. Similarly, as shown in FIG. 6, as the flexion angle of the right knee joint (hereinafter, referred to as "knee joint flexion angle"), a flexion angle is obtained for a case where a rectangular coordinate system (x', y', z') is set with the three light-reflective markers 201 at the right lower leg, and the vectors obtained respectively from the coordinates of the two light-reflective markers 201 at the right thigh are projected onto a plane corresponding to a sagittal plane at these rectangular coordinates. Similarly, as shown in FIG. 6, as the left knee joint flexion angle, a flexion angle is obtained for a case where a rectangular coordinate system (x", y", z") is set with the three light-reflective markers 201 at the left lower leg, and the vectors obtained respectively from the coordinates of the two light-reflective markers 201 at the left thigh are projected onto a plane corresponding to a sagittal plane at these rectangular coordinates. Then, the right and left hip joint flexion angles and the right and left hip joint flexion angles determined from information of the spatial coordinates of the light-reflective markers that has been obtained from one spike jump are output to the information processing apparatus 100 as a single piece of motion information. Here, since measurement is performed on a total of two spike jumps, two pieces of motion information are output. The configuration and processes for acquiring information on a variety of motions of the human body from the spatial coordinates of light-reflective markers in this way are publicly known, and therefore, their further description has been omitted here.

Figure 7A:
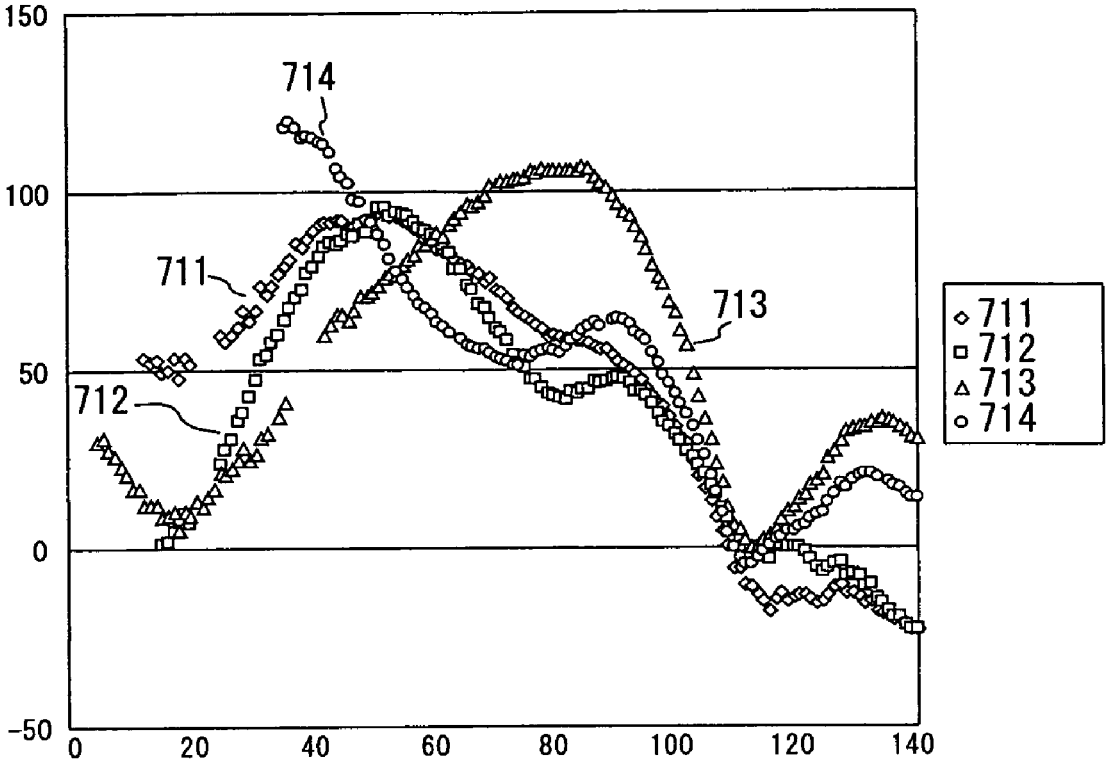
FIG. 7A and FIG. 7B are graphs showing pieces of motion information received by the information processing apparatus.
Figure 7B:
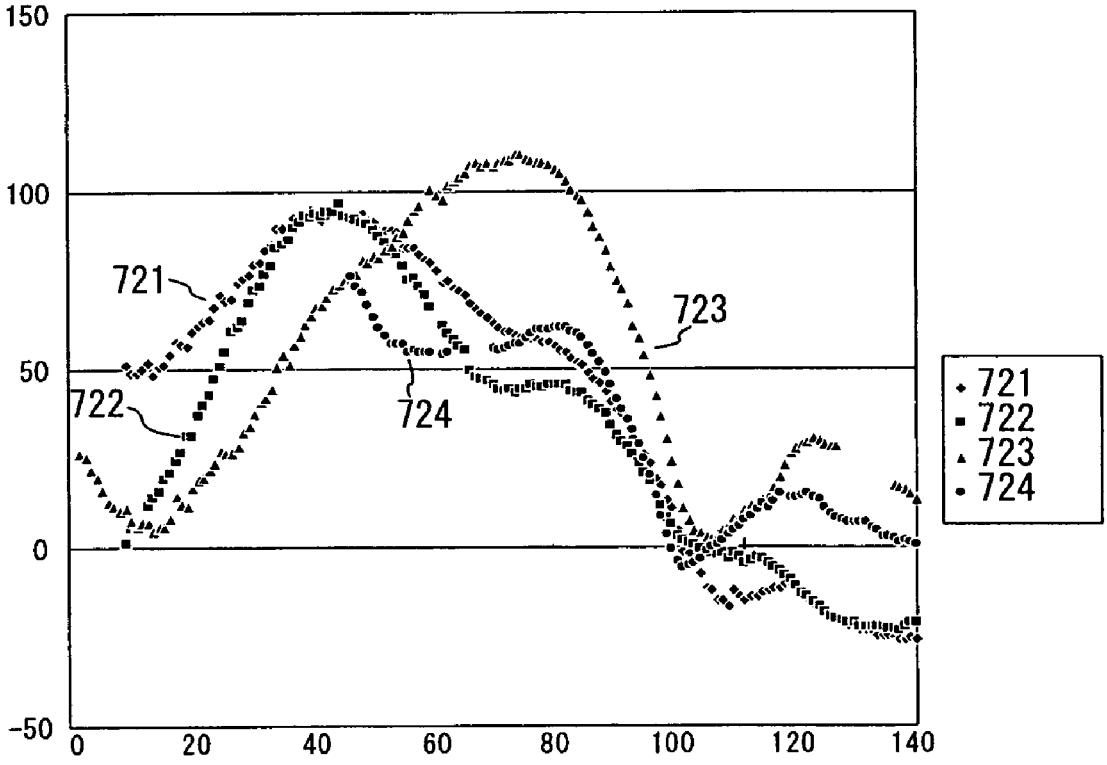

The motion information receiving portion 101 of the information processing apparatus 100 receives the two pieces of motion information that are output from the motion acquisition apparatus 200. The pieces of motion information received by the motion information receiving portion 101 are two pieces of motion information as shown in FIG. 7A and FIG. 7B, and motion information as shown in FIG. 7A is taken as first motion information. Here, motion information as shown in FIG. 7B is taken as second motion information. The first motion information includes four pieces of information, namely, a right hip joint flexion angle 711, a left hip joint flexion angle 712, a right knee joint flexion angle 713 and a left knee joint flexion angle 714. The second motion information includes four pieces of information, namely, a right hip joint flexion angle 721, a left hip joint flexion angle 722, a right knee joint flexion angle 723 and a left knee joint flexion angle 724. That is to say, each motion information is constituted by four curves. Additionally, in FIG. 7A and FIG. 7B, the horizontal axis represents the number of times of sampling from the start of sampling, and the vertical axis represents the values of each motion information. This also applies to other graphs in this embodiment.

Then, the correlation information acquisition portion 103 determines the average value of the absolute value of a difference between the first motion information and the second motion information at multiple times as correlation information between the first motion information and the second motion information. Here, since the first and the second motion information each include four pieces of information, i.e., four curves, it is possible to determine the sum of the absolute value of a difference between the corresponding four pieces of information for the first and the second motion information at each point in time to eventually determine the average value of the sums of the absolute values of the differences. However, by doing so, the values at times at which the four pieces of information are not all present will be ignored, so that it may not be possible to attain accurate results. Therefore, here, the absolute value of the difference is determined at each point in time for each of the four pieces of information to eventually determine the average value for each of the four pieces of information, and then the average value of the four average values is further determined. Thus, the order and the like of calculation may be changed as necessary in this embodiment.

Figure 8:
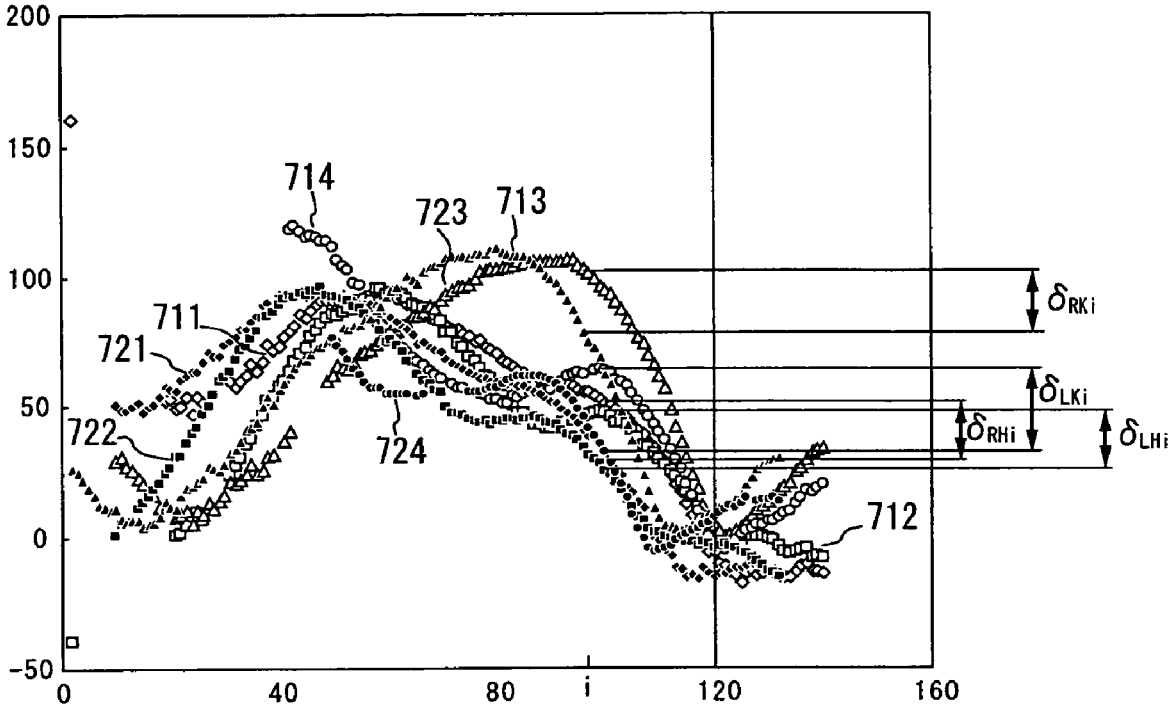
FIG. 8 is a graph showing a difference between pieces of motion information received by the information processing apparatus.

To determine the average value, the correlation information acquisition portion 103 first determines the absolute values of differences between the corresponding pieces of information constituting the first motion information and the second motion information at a same time. When the absolute value of a difference between the right hip joint flexion angle 711 and the right hip joint flexion angle 721 at the time i is $\delta_{RHi}$, the absolute value of a difference between the left hip joint flexion angle 712 and the left hip joint flexion angle 722 at the time i is $\delta_{RHi}$, the absolute value of a difference between the right knee joint flexion angle 713 and the right knee joint flexion angle 723 at the time i is $\delta_{LHi}$, and the absolute value of a difference between the left knee joint flexion angle 714 and the left knee joint flexion angle 724 at the time i is $\delta_{LKi}$, these pieces of motion information are as shown in FIG. 8.

First, the absolute value of a difference between the right hip joint flexion angle 711 and the right hip joint flexion angle 721, the absolute value of a difference between the left hip joint flexion angle 712 and the left hip joint flexion angle 722, the absolute value of a difference between the right knee joint flexion angle 713 and the right knee joint flexion angle 723, and the absolute value of a difference between the left knee joint flexion angle 714 and the left knee joint flexion angle 724 are each determined at a predetermined start time. At this time, if any one of these information pairs is not present, then the difference between that pair will not be calculated. Here, the predetermined start time is set to the 10th sampling point, i.e., the time at which 1/24 second has elapsed from the sampling start time. Then, each of the obtained absolute values of a difference is stored in a memory or the like.

The correlation information acquisition portion 103 repeatedly performs a similar process of determining the absolute value of a difference at each sampling time of the motion information. This process is performed until a preset end time. Here, the end time is set to the 120th sampling point, i.e., the time at which 0.5 second has elapsed from the sampling start time.

Then, after determining the absolute value of a difference at all the sampling times, the correlation information acquisition portion 103 determines the average value of these absolute values of a difference. Here, when the number of the obtained differences is taken as n, the average value $\epsilon_{RH}$ of the absolute value of a difference between the right hip joint flexion angle 711 and the right hip joint flexion angle 721 can be expressed using the following equation (1). Similarly, the average value $\epsilon_{LH}$ of the absolute value of a difference between the left hip joint flexion angle 712 and the left hip joint flexion angle 722 can be expressed using the following equation (2). Similarly, the average value $\epsilon_{RK}$ of the absolute value of a difference between the right knee joint flexion angle 713 and the right knee joint flexion angle 723 can be expressed using the following equation (3). Similarly, the average value of the absolute value of a difference $\epsilon_{LK}$ between the left knee joint flexion angle 714 and the left knee joint flexion angle 724 can be expressed using the following equation (4).

$$\varepsilon_{RH} = \frac{1}{n}\sum_{i=10}^{120}\delta_{RHi} \tag{1}$$

$$\varepsilon_{LH} = \frac{1}{n}\sum_{i=10}^{120}\delta_{LHi} \tag{2}$$

$$\varepsilon_{RK} = \frac{1}{n}\sum_{i=10}^{120}\delta_{RKi} \tag{3}$$

-continued $$\varepsilon_{LK} = \frac{1}{n}\sum_{i=10}^{120}\delta_{LKi} \tag{4}$$

In the equation (1) to the equation (4), if no difference is obtained between the first motion information and the second motion information, then addition is performed taking the difference value as 0, and this will not be added to the number n of the obtained differences.

Then, the correlation information acquisition portion 103 determines the average value $\epsilon$ of the average values $\epsilon_{RH}$, $\epsilon_{LH}$, $\epsilon_{RK}$, $\epsilon_{LK}$, i.e., $(\epsilon_{RH}+\epsilon_{LH}+\epsilon_{RK}+\epsilon_{LK})/4$. This average value $\epsilon$ is the correlation information between the first motion information and the second motion information received by the motion information receiving portion 101.

Figure 9:
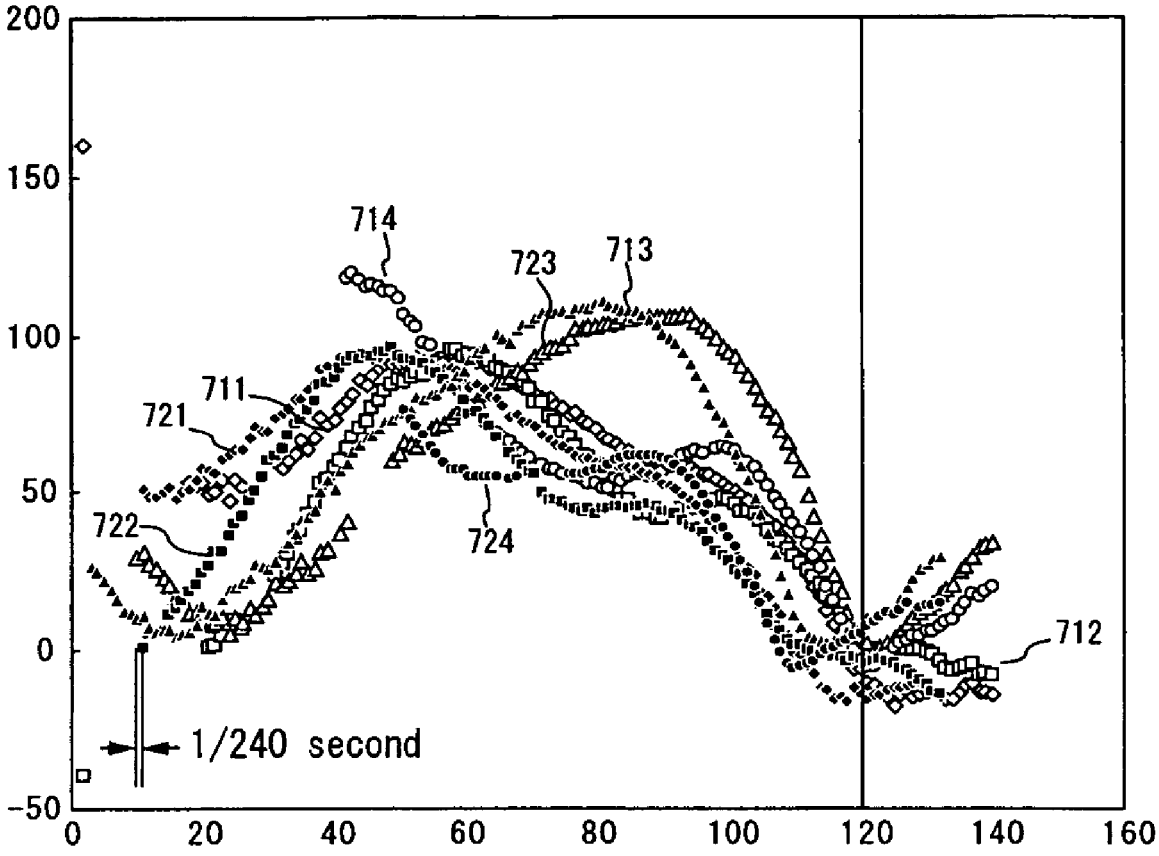
FIG. 9 is a graph showing pieces of motion information shifted by the information processing apparatus.

Next, in the motion information alteration portion 102, the entire second motion information is shifted in the time axis direction by one sampling time interval, i.e., 1/240 second to form the first motion information and the second motion information whose positional relationship in the time axis direction has been shifted by one sampling time interval. These pieces of motion information are as shown in FIG. 9.

Then, the correlation information acquisition portion 103 determines $\epsilon$ for these first motion information and second motion information in the same manner as described above.

Further, in the motion information alteration portion 102, the second motion information is further shifted by one sampling time interval in the above-described manner to form the first motion information and the second motion information whose positional relationship in the time axis direction has been further shifted by one sampling time interval, and the correlation information acquisition portion 103 repeatedly performs the process of determining the value of $\epsilon$ for these first motion information and second motion information in the same manner as described above. Here, this process is repeated twelve times.

Figure 10A:
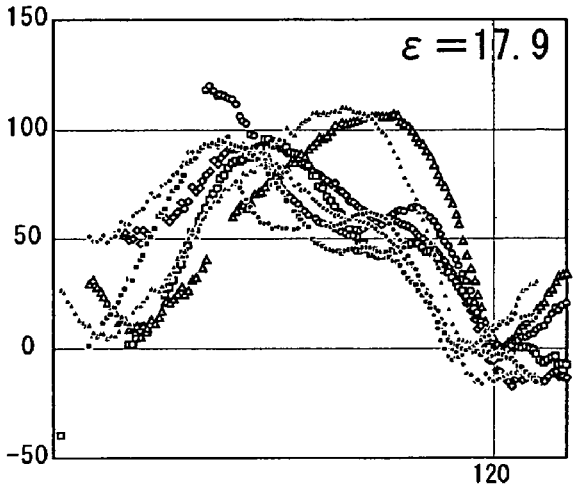
FIG. 10A to FIG. 10F are graphs showing pieces of motion information shifted by the information processing apparatus.
Figure 10B:
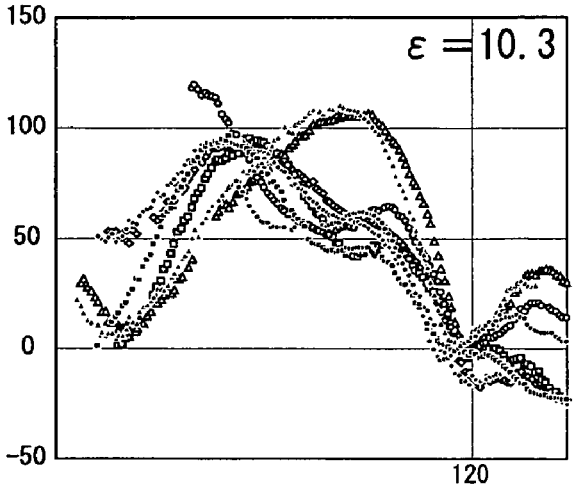
Figure 10C:
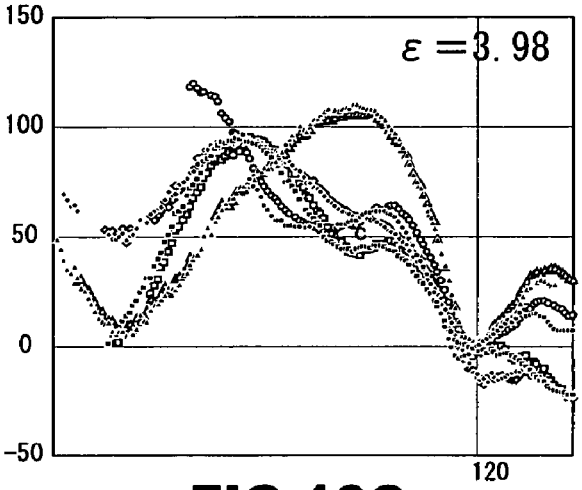
Figure 10D:
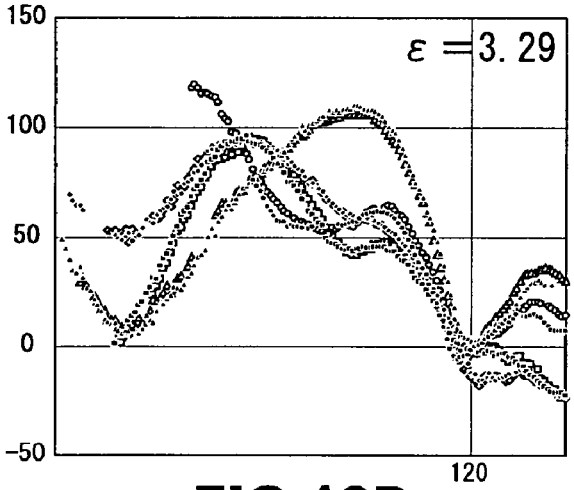

FIG. 10A to FIG. 10F are graphs showing the relationship between $\epsilon$ and the first and the second motion information whose positional relationship in the time axis direction has been altered in the motion information alteration portion 102. FIG. 10A shows the first and the second motion information as were received by the motion information receiving portion 101, FIG. 10B shows the first and the second motion information in a state where the second motion information has been shifted to the right by 5 sampling points, FIG. 10C shows the first and the second motion information in a state where the second motion information has been shifted to the right by 4 sampling points from the state shown in FIG. 10B, and FIG. 10D through FIG. 10F show the first and the second motion information in a state where the second motion information has been sequentially shifted to the right by one sampling point from the state shown in FIG. 10C. From these graphs, it can be seen that $\epsilon$ is smallest for the first and the second motion information in the state shown in FIG. 10E.

The motion information acquisition portion 104 compares the values of $\epsilon$ acquired by the correlation information acquisition portion 103, and acquires the first and the second motion information for which $\epsilon$ is smallest, from the motion information alteration portion 102. Here, it acquires the first motion information and the second motion information having a positional relationship in the time axis direction as shown in FIG. 10E, for which $\epsilon$ has the smallest value 3.02.

Figure 10E:
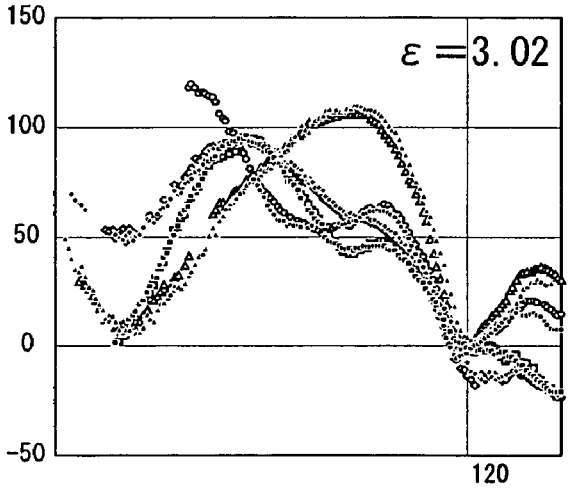
Figure 10F:
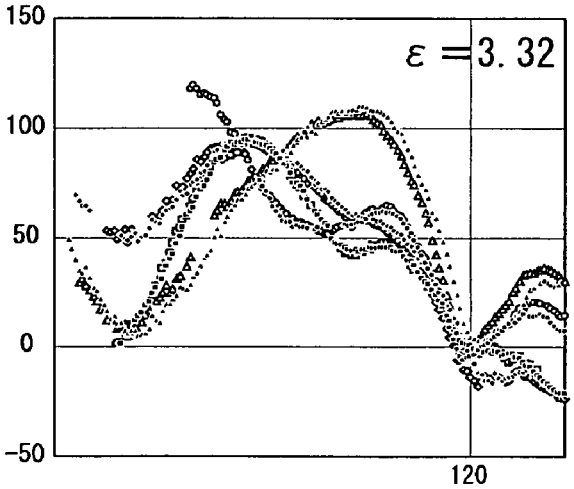
Figure 11:
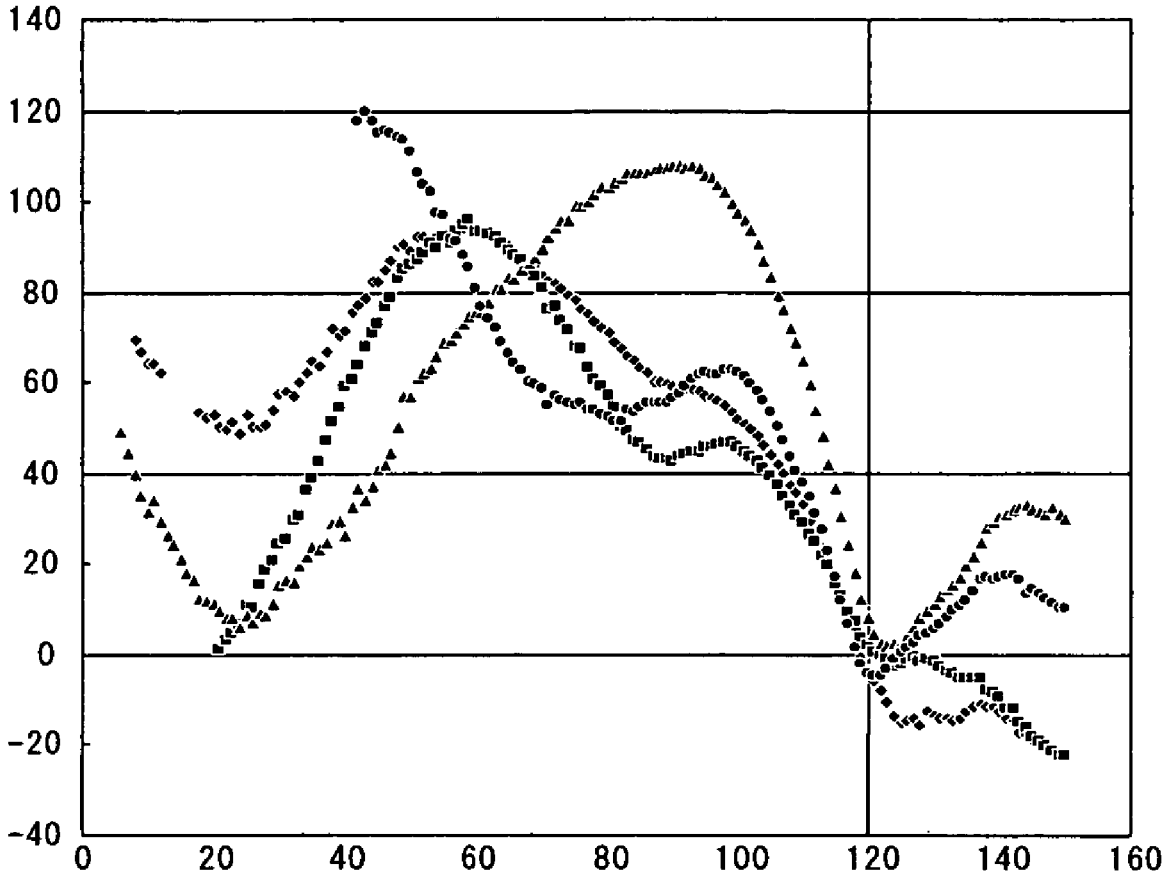
FIG. 11 is a graph showing pieces of motion information synthesized by the information processing apparatus.

The motion information synthesizing portion 105 synthesizes the first motion information and the second motion information as shown in FIG. 10E that have been acquired by the motion information acquisition portion 104. Here, the average value of the value of the first motion information and the value of the second motion information at each sampling time is set to the value of the motion information synthesized at that sampling time, thereby forming synthesized motion information. The synthesized motion information is as shown in FIG. 11.

Thus, by determining the correlation between two pieces of motion information, while shifting the positional relationship in the time axis direction between the two pieces of motion information, and aligning the two pieces of motion information in the time axis direction such that the correlation is highest, it is possible to align the two pieces of motion information in the time axis direction such that they are in a positional relationship that can be considered optimal from an objective standpoint, without altering the respective waveforms of the two pieces of motion information. By synthesizing the two pieces of motion information that have been aligned in this way to obtain motion information, it is possible to obtain motion information with high reliability and good reproducibility. Accordingly, by using motion information synthesized in this way as typical motion information of the subject while performing a spike jump, it is possible to analyze the form more accurately.

Figure 12:
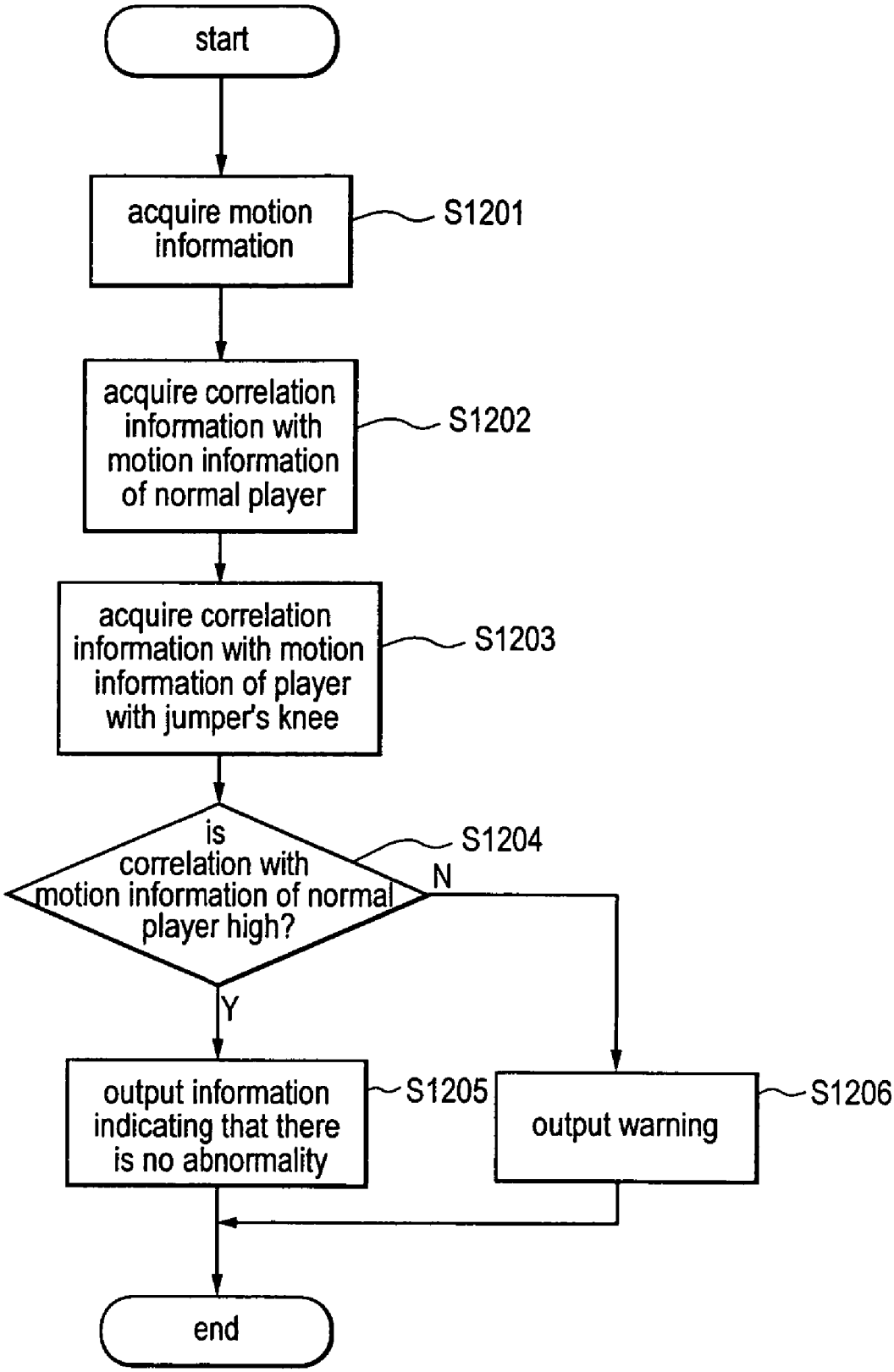
FIG. 12 is a flowchart for illustrating the operation of the information processing apparatus.

Next, the motion information of the subject that has been synthesized in the motion information synthesizing portion 105 is analyzed in the information analyzing portion 106. In the following, a specific example of the motion information analyzing process performed by the motion information analyzing portion 106 will be described with reference to the flowchart of FIG. 12. This process corresponds to the process of Step S214 shown in FIG. 2. Here, it is assumed that in the motion information analyzing portion 106, the typical motion information while performing a jump spike of a player with jumper's knee and that of a player without jumper's knee that were obtained as a result of performing a process similar to the above-described process of acquiring motion information for a player with jumper's knee and a normal player without jumper's knee has been stored in a memory or the like in advance.

(Step S1201) The motion information analyzing portion 106 acquires the motion information from the motion information synthesizing portion 105.

(Step S1202) The motion information analyzing portion 106 acquires correlation information between the motion information of the subject that has been obtained in Step S1201 and the motion information of the normal player that has been stored in a memory or the like. For example, it performs a process similar to that described in Step S201 through Step S211 above to acquire the correlation information indicating the highest correlation among the pieces of correlation information between two pieces of motion information that are obtained by shifting the positional relationship in the time axis direction of the two pieces of motion information. Here, the motion information analyzing portion 106 acquires the smallest average value among the average values of the absolute value of a difference between the motion information of the subject and the motion information of the normal player at the respective sampling times that are obtained when the positional relationship in the time axis direction between these pieces of motion information is shifted.

(Step S1203) As in Step S1202, the motion information analyzing portion 106 acquires correlation information between the motion information of the subject that has been acquired in Step S1201 and the motion information of the player with jumper's knee that has been stored in a memory or the like. It should be noted that the processes of Step S1202 and Step S1203 may be performed in any order.

(Step S1204) The motion information analyzing portion 106 compares the correlation information acquired in Step S1202 and that acquired in Step S1203. If the correlation information acquired in Step S1202 indicates a higher correlation than the correlation information acquired in Step S1203, then the procedure advances to Step S1205, and if it does not indicate a higher correlation, then the procedure advances to Step S1206. Here, the one of the average values respectively acquired in Step S1202 and Step S1203 that has a smaller value indicates a higher correlation. It should be noted that the procedure may also advance to Step S1205 if the correlation information acquired in Step S1202 and the correlation information acquired in Step S1203 indicate the same correlation.

(Step S1205) Information indicating that there is no problem with the form while performing a spike jump of the subject is output as an analysis result. Then, the process is terminated.

(Step S1206) A warning indicating that there is the possibility that the form while performing a spike jump of the subject may cause jumper's knee is output as an analysis result.

Figure 13A:
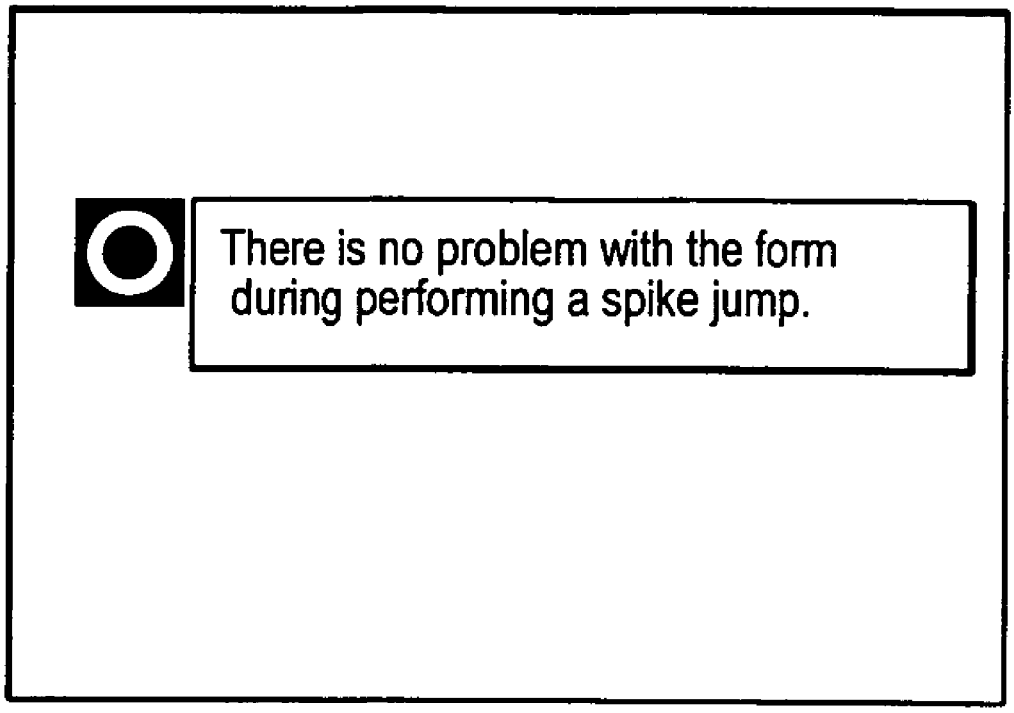
FIG. 13A and FIG. 13B are diagrams showing exemplary displays of the information processing apparatus.
Figure 13B:
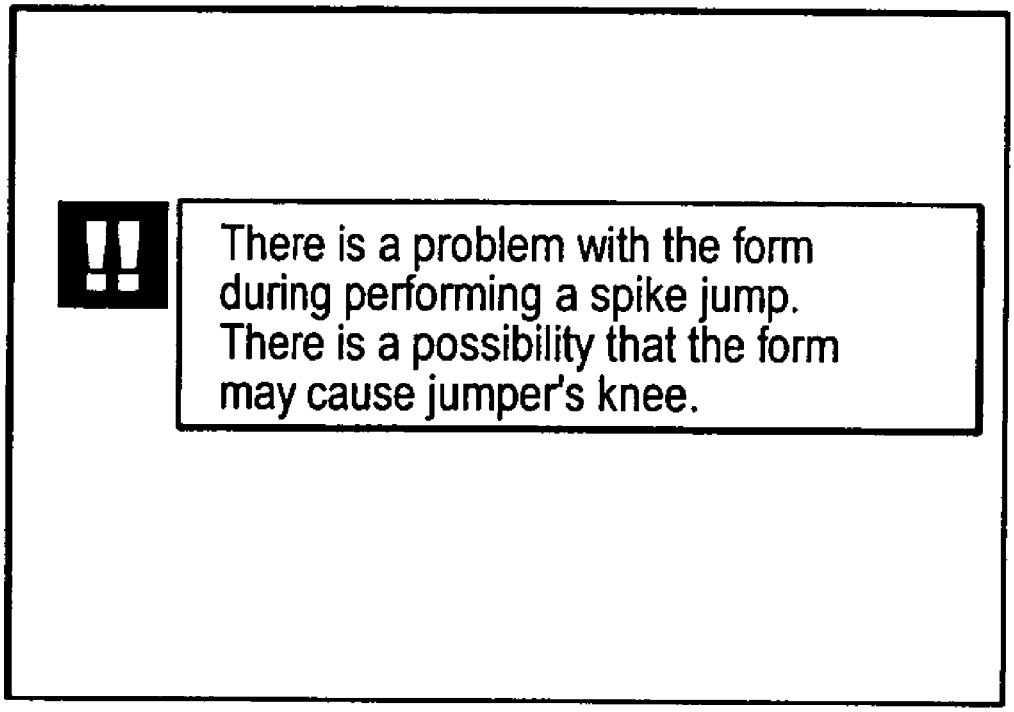

The output portion 107 displays the analysis result that is output by the motion information analyzing portion 106 on a display or the like. FIG. 13A and FIG. 13B are diagrams showing exemplary displays that are output on a display by the output portion 107. FIG. 13A shows an exemplary display based on the analysis result obtained in Step S1205 described above, and FIG. 13B shows an exemplary display based on the analysis result obtained in Step S1206 described above. With these displays, the subject can know whether his or her form while performing a spike jump tends to cause jumper's knee.

Thus, the correlation between the motion information of the subject and that of the normal player, and the correlation between the motion information of the subject and that of the player with jumper's knee can be each obtained, after objectively aligning each of the motion information pairs in the time axis direction, so that it is possible to output a highly reliable analysis result. Accordingly, it is possible to perform objective analysis of form and the like, which has largely depended on the experiences or subjective views of doctors or trainers, thus realizing analysis with high reliability and good reproducibility. Furthermore, by outputting a result of objective analysis, users without sufficient experiences or techniques to analyze motion information in the form of graphs or the like can readily obtain a highly reliable analysis result.

Here, the motion information analyzing portion 106 only analyzes whether the form of the subject tends to cause jumper's knee. However, if a disorder other than jumper's knee is found to have some association with the form while performing a spike jump, then it is possible to store the typical form of a player having such a disorder, and to compare the correlation information between those forms and the typical form of the subject with the correlation information between the normal form and the typical form of the subject in the above-described manner, thereby analyzing, for example, whether the form of the subject tends to cause the disorder different from jumper's knee, or whether the early symptoms of any disorder have appeared.

In this specific example, a case was described where each motion information is constituted by multiple pieces of information, namely, four curves, but needless to say, this embodiment can also be applied to a case where each motion information is constituted by a single piece of information, namely a single curve.

As described above, according to this embodiment, it is possible to objectively align multiple pieces of motion information in the time axis direction. Moreover, by processing the multiple pieces of motion information, it is possible to obtain information with high reliability and good reproducibility, including, for example, synthesized motion information and information such as an analysis result.

In the specific example of the embodiment described above, a case was described where the information processing apparatus 100 processes two pieces of motion information. However, the information processing apparatus 100 may process three or more pieces of motion information. In this case, for example, the motion information alteration portion 102 may shift pieces of motion information as necessary to provide multiple combinations of motion information in such a manner that the positional relationships in the time axis direction between the pieces of motion information vary, then the correlation information acquisition portion 103 may determine the correlation information for each of them as described above, and the motion information acquisition portion 104 may acquire pieces of motion information in a positional relationship in the time axis direction at which the correlation information is optimal.

Figure 2:
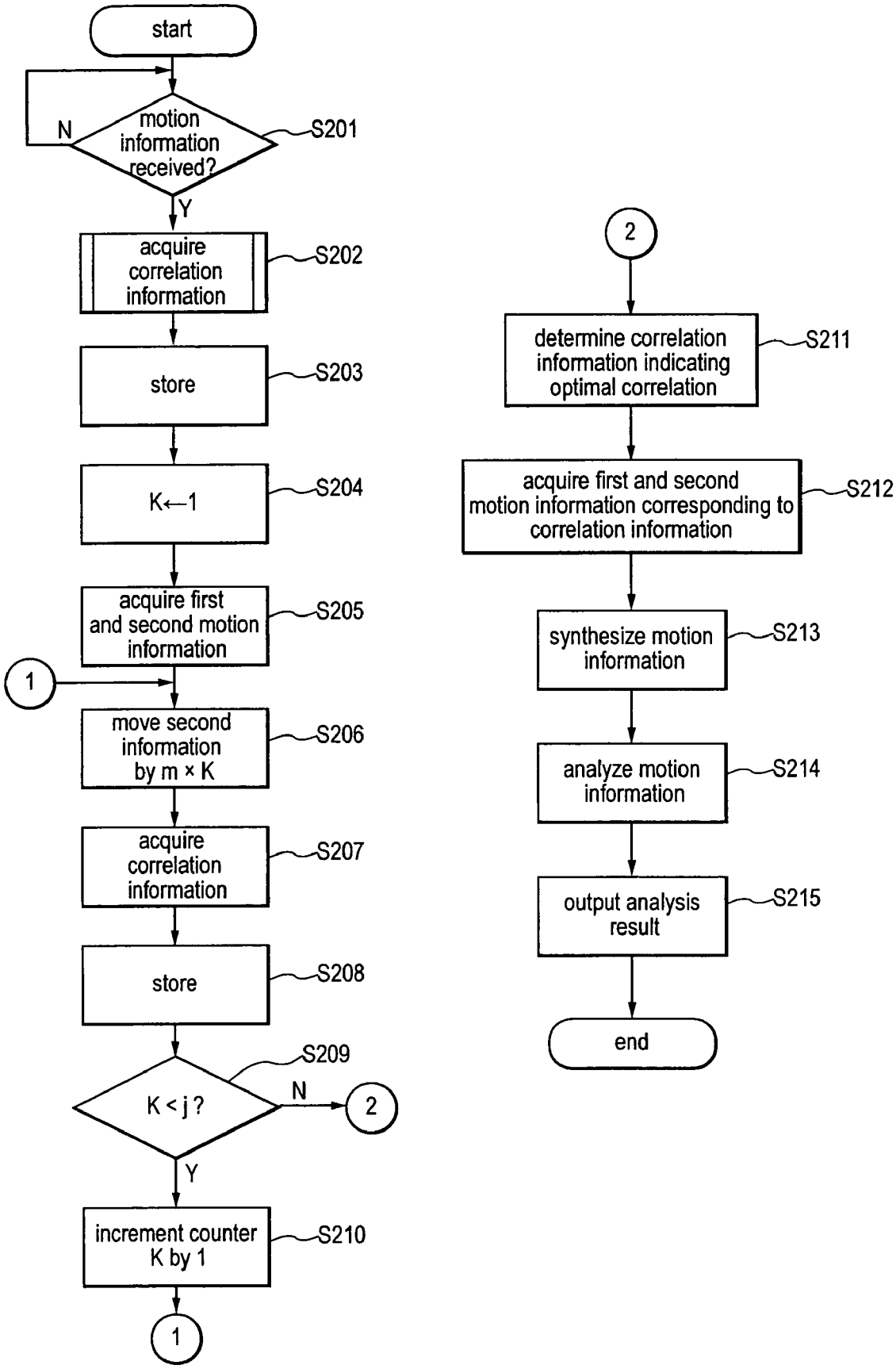
FIG. 2 is a flowchart for illustrating the operation of the information processing apparatus.
Figure 3:
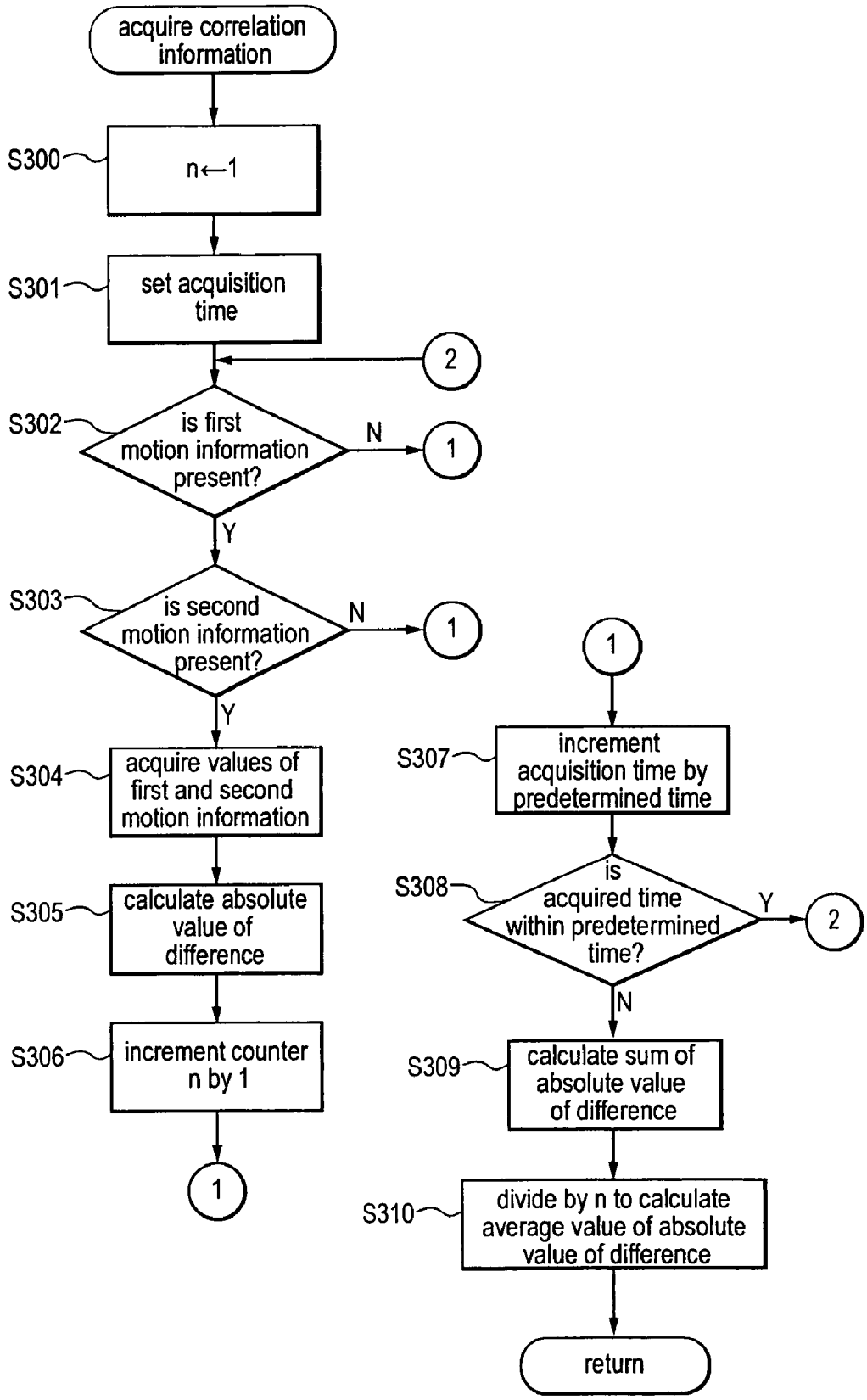
FIG. 3 is a flowchart for illustrating the operation of the information processing apparatus.

Further, in this embodiment, the second motion information is shifted by the predetermined amount m in order to change the positional relationship in the time axis direction between the first motion information and the second motion information, as shown in Step S206 of FIG. 2. Instead, it is possible, in advance, to sequentially shift the second correlation information by a first predetermined amount having a large value (e.g., a value obtained by multiplying the sampling time interval by 5) to determine the correlation information between the first correlation information and the second correlation information, then to determine, from the determined correlation information, a positional relationship in the time axis direction at which the correlation is optimal, and then to sequentially shift the entire second correlation information by a second predetermined amount having a value smaller than the first predetermined amount (e.g., a value that is obtained by multiplying the sampling time interval by 1) for the positional relationships in the vicinity of the determined positional relationship to determine the correlation information between the first correlation information and the second correlation information, thereby determining the first correlation information and the second correlation information in a positional relationship in the time axis direction at which the correlation information is optimal. By performing these processes, the correlation information between the first motion information and the second motion information having a positional relationship in the time axis direction at which the correlation between the pieces of motion information is optimal can be acquired with a smaller amount of information to be processed, than by shifting the second motion information only by a predetermined amount having a small value. It is also possible to apply a method used for increasing the processing speed for searching, such as the so-called binary search method, to the above-described process of determining the first motion information and the second motion information having a positional relationship in the time axis direction at which the correlation between the pieces of motion information is optimal.

When the information processing apparatus 100 processes two pieces of motion information in the above-described embodiment, it is possible to let the information processing apparatus 100 process the two pieces of motion information first, then to let the motion information synthesizing portion 105 synthesize the two pieces of motion information, then to input synthesized pieces of motion information into the motion information receiving portion 101, together with new motion information, and finally to let the information processing apparatus 100 process three or more pieces of the motion information.

Figure 14:
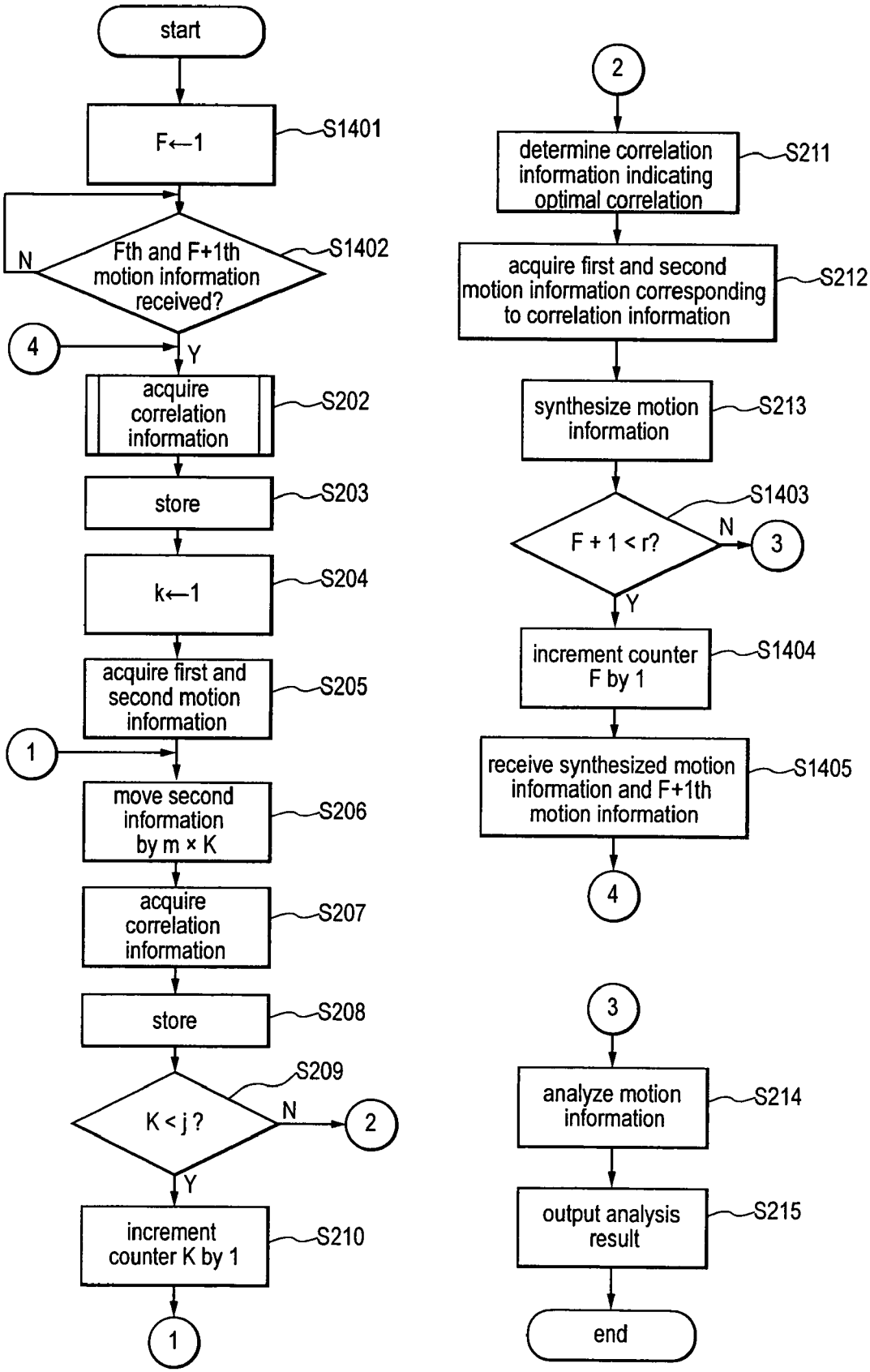
FIG. 14 is a flowchart for illustrating the operation of the information processing apparatus.

In the following, the operation of the information processing apparatus 100 will be described with reference to the flowchart shown in FIG. 14 for a case where the motion information synthesized by the motion information synthesizing portion 105 is input into the motion information receiving portion 101, together with new motion information, and the information processing apparatus 100 processes three or more pieces of motion information. It should be noted that in the drawing, the same reference numerals as in FIG. 2 denote the same or corresponding processes. Here, a case will be described where the information processing apparatus 100 synthesized r (r is an integer equal to or greater than 3) pieces of motion information. In addition, it is assumed that the r pieces of motion information are stored in a memory or the like by, for example, the motion acquisition apparatus, and that each of the stored pieces of motion information is output to the information processing apparatus 100 by, for example, the motion acquisition apparatus in response to a request from the information processing apparatus 100.

(Step S1401) The motion information receiving portion 101 sets the counter F to 1.

(Step S1402) The motion information receiving portion 101 judges whether the Fth motion information and the F+1th motion information have been received. If they have been received, then the procedure advances to Step S202, and if they have not been received, then the procedure returns to Step S1402. The Fth motion information corresponds to the first motion information described in the above-described embodiment, and the F+1th motion information corresponds to the second motion information.

(Step S1403) The motion information synthesizing portion 105 judges whether F+1 is smaller than r. If it is smaller than r, the procedure advances to Step S1404, and if it is not smaller, the procedure advances to Step S214.

(Step S1404) The motion information receiving portion 101 increments the counter F by 1.

(Step S1405) The motion information receiving portion 101 receives the motion information synthesized in Step S213 and the F+1th motion information. The motion information synthesized in Step S213 corresponds to the first motion information, and the F+1th motion information corresponds to the second motion information. Then, the procedure returns to Step S202.

By performing the above-described processes, it is possible to process three or more pieces of motion information, even if the information processing apparatus 100 receives and processes two pieces of motion information at a time. Here, when the information processing apparatus 100 receives and processes three or more pieces of motion information, the number of combinations of the positional relationship in the time axis direction between the pieces of motion information is extremely large, so that the amount of information to be processed before synthesizing the motion information increases. Therefore, the process requires an extremely long time if an information processing apparatus with a low processing speed is used. On the other hand, by repeating a process as shown in FIG. 14 in which two pieces of motion information are synthesized and the pieces of motion information resulting from this synthesis and new motion information are further synthesized, the amount of information to be processed can be reduced, making it possible to reduce the processing time even in the case of an information processing apparatus with a low processing speed.

In this embodiment, a case was described where the analysis was performed on motion of volleyball players, but the present invention can also be applied to the analysis on motion of baseball players. For example, Tatsuaki Nakamura, et al., "An attempt at study of motion analysis for factors causing pitching disorders" Journal of Kansai Clinical Sports Medicine and Science vol. 9, pp. 31 and 32, 1999, discloses acquiring motion information of the pitching motion of a baseball pitcher using a motion capture apparatus. By using the information processing apparatus 100 described in this embodiment for analyzing such motion information, it is possible to attain an analysis result with high reliability and good reproducibility. In addition, needless to say, the information processing apparatus according to this embodiment can also be applied to sports other than baseball, as long as motion information can be acquired.

In this embodiment, when it is not necessary to synthesize the information acquired by the motion information acquisition portion 104, or to analyze the synthesized information, the motion information synthesizing portion 105 and the motion information analyzing portion 106 may be omitted, and the output portion 107 may output multiple pieces of motion information acquired by the motion information acquisition portion 104.

It should be noted that each process (each functionality) in the above-described embodiments may be realized by centralized processing with a single apparatus (system), or may be realized by distributed processing with multiple apparatuses.

Further, each component in the above-described embodiments may be constituted by dedicated hardware. Alternatively, components that can be implemented with software may be implemented by executing a program. For example, each component may be implemented by reading out and executing a software program recorded in a recording medium such as a hard disk or a semiconductor memory with a program execution portion such as a CPU. It should be noted that the software that realizes the information processing apparatus in each of the above-described embodiments is a program as described below. That is, this program is a program for letting a computer execute: a motion information receiving step of receiving multiple pieces of motion information, which is time-series information relating to motion of an object; a motion information alteration step of altering a positional relationship in a time axis direction between the multiple pieces of the motion information; a correlation information acquisition step of acquiring, for multiple pieces of the motion information, correlation information, which is information relating to a correlation between pieces of the motion information; and a motion information acquisition step of acquiring, based on the correlation information, multiple pieces of the motion information having a positional relationship in the time axis direction at which the correlation between those pieces of the motion information is optimal.

Furthermore, in the above-described program, the motion information alteration step shifts at least one piece of the motion information in the time axis direction, thereby altering the positional relationship in the time axis direction between the multiple pieces of the motion information.

Furthermore, in the above-described program, the correlation information acquisition step acquires the correlation information based on values of the multiple pieces of the motion information at two or more predetermined times.

Furthermore, in the above-described program, the correlation information is an average value of an absolute value of a difference between values of the multiple pieces of the motion information at two or more predetermined times.

Furthermore, in the above-described program, the motion information acquisition step acquires multiple pieces of the motion information having a positional relationship in the time axis direction that renders the average value small.

Furthermore, in the above-described program, the program further lets the computer execute: a motion information synthesizing step of synthesizing the multiple pieces of the motion information acquired by the motion information acquisition step; and an output step of outputting the motion information synthesized by the motion information synthesizing step.

Furthermore, in the above-described program, wherein the motion information synthesizing step forms motion information having as its values at multiple times an average of values of the multiple pieces of the motion information at the corresponding multiple times that are acquired by the motion information acquisition step.

Furthermore, in the above-described program, the program further lets the compute execute: a motion information analyzing step of analyzing the motion information synthesized by the motion information synthesizing step, and wherein the output step outputs an analysis result of the motion information analyzing step.

Furthermore, in the above-described program, the motion information receiving step receives two pieces of the motion information, and one of the pieces of the motion information is the motion information that is output by the output step.

It should be noted that this program may be executed by downloading from a server or the like, or by reading out the program recorded in a predetermined recording medium (e.g., an optical disk such as a CD-ROM, a magnetic disk, or a semiconductor memory).

In addition, this program may be executed with a single computer, or multiple computers. In other words, the program may be executed by performing centralized processing or distributed processing.

Furthermore, needless to say, the present invention is not limited to the above-described embodiments, and susceptible to various modifications, which also fall within the scope of the present invention.

The present invention is suitable as an information processing apparatus or the like for processing information relating to motion of objects, and particularly suitable as an information processing apparatus or the like for processing and analyzing information or the like relating to motion of humans while performing sports.

What is claimed is:

1. An information processing apparatus comprising:

a motion information receiving portion that receives at least first and second pieces of motion information, which is time-series information relating to multiple instances of same motion of an object;

a motion information alteration portion that alters a positional relationship of the second piece of motion information in a time axis direction to obtain third multiple pieces of the motion information;

a correlation information acquisition portion that acquires correlation information relating to a correlation between the first piece of motion information and each of the third multiple pieces of the motion information; and a motion information acquisition portion that acquires, based on the correlation information, one of the third pieces of the motion information, which is optimal.

2. The information processing apparatus according to claim 1, wherein the motion information alteration portion shifts at least one piece of the motion information in the time axis direction, thereby altering the positional relationship in the time axis direction between the multiple pieces of the motion information.

3. The information processing apparatus according to claim 1, wherein the correlation information acquisition portion acquires the correlation information based on values of the multiple pieces of the motion information at two or more predetermined times.

4. The information processing apparatus according to claim 1, wherein the correlation information is an average value of an absolute value of a difference between values of the multiple pieces of the motion information at two or more predetermined times.

5. The information processing apparatus according to claim 4, wherein the motion information acquisition portion acquires multiple pieces of the motion information having a positional relationship in the time axis direction that renders the average value small.

6. The information processing apparatus according to claim 1, wherein the motion information is information obtained by sampling motion of an object with a predetermined sampling time interval, and wherein the motion information alteration portion shifts at least one of the pieces of the motion information in the time axis direction, taking an integer multiple of the sampling time interval as a time unit, thereby altering the positional relationship in the time axis direction of the pieces of the motion information.

7. The information processing apparatus according to claim 6, wherein the correlation information is an average value of an absolute value of a difference between values of the multiple pieces of the motion information at two or more predetermined times that are set taking the sampling time interval as a time unit.

8. The information processing apparatus according to claim 1, further comprising:

a motion information synthesizing portion that synthesizes the multiple pieces of the motion information acquired by the motion information acquisition portion; and an output portion that outputs the motion information synthesized by the motion information synthesizing portion.

9. The information processing apparatus according to claim 8, wherein the motion information synthesizing portion forms motion information having as its values at multiple times an average of values of the multiple pieces of the motion information at the corresponding multiple times that are acquired by the motion information acquisition portion.

10. The information processing apparatus according to claim 8, wherein the motion information receiving portion receives two pieces of the motion information, and wherein one of the pieces of the motion information is the motion information that is output by the output portion.

11. The information processing apparatus according to claim 1, further comprising:

a motion information analyzing portion that analyzes the motion information synthesized by the motion information synthesizing portion, wherein the output portion outputs an analysis result of the motion information analyzing portion.

12. The information processing apparatus according to claim 1, wherein the motion information is information relating to a motion while playing volleyball.

13. The information processing apparatus according to claim 1, wherein the motion information is information relating to a motion while playing baseball.

14. An information processing method comprising:

a motion information receiving step of receiving at least first and second pieces of multiple instances of same motion information, which is time-series information relating to motion of an object;

a motion information alteration step of altering a positional relationship of the second piece of motion information in a time axis direction to obtain third multiple pieces of the motion information;

a correlation information acquisition step of acquiring correlation information relating to a correlation between the first piece of motion information and each of the third multiple pieces of the motion information; and a motion information acquisition step of acquiring, based on the correlation information, one of the third pieces of the motion information, which is optimal.

15. A computer readable storage medium storing a program for letting the computer execute:

a motion information receiving step of receiving at least first and second pieces of motion information, which is time-series information relating to multiple instances of same motion of an object;

a motion information alteration step of altering a positional relationship of the second piece of motion information in a time axis direction to obtain third multiple pieces of the motion information;

a correlation information acquisition step of acquiring correlation information relating to a correlation between the first piece of motion information and each of the third multiple pieces of the motion information; and a motion information acquisition step of acquiring, based on the correlation information, one of the third pieces of the motion information, which is optimal.

16. The storage medium according to claim 15, wherein the motion information alteration step shifts at least one piece of the motion information in the time axis direction, thereby altering the positional relationship in the time axis direction between the multiple pieces of the motion information.

17. The storage medium according to claim 15, wherein the correlation information acquisition step acquires the correlation information based on values of the multiple pieces of the motion information at two or more predetermined times.

18. The storage medium according to claim 15, wherein the correlation information is an average value of an absolute value of a difference between values of the multiple pieces of the motion information at two or more predetermined times.

19. The storage medium according to claim 18, wherein the motion information acquisition step acquires multiple pieces of the motion information having a positional relationship in the time axis direction that renders the average value small.

20. The storage medium according to claim 15, wherein the program further lets the computer execute:

a motion information synthesizing step of synthesizing the multiple pieces of the motion information acquired by the motion information acquisition step; and an output step of outputting the motion information synthesized by the motion information synthesizing step.

21. The storage medium according to claim 20, wherein the motion information synthesizing step forms motion information having as its values at multiple times an average of values of the multiple pieces of the motion information at the corresponding multiple times that are acquired by the motion information acquisition step.

22. The storage medium according to claim 20, wherein the program further lets the compute execute:

a motion information analyzing step of analyzing the motion information synthesized by the motion information synthesizing step, and wherein the output step outputs an analysis result of the motion information analyzing step.

23. The storage medium according to claim 20, wherein the motion information receiving step receives two pieces of the motion information, and wherein one of the pieces of the motion information is the motion information that is output by the output step.

* * * * *